US011992118B1

(12) United States Patent
Crudo et al.

(10) Patent No.: US 11,992,118 B1
(45) Date of Patent: May 28, 2024

(54) HEAVY-DUTY DESIGNER TABLE APRON

(71) Applicant: NPS Public Furniture Corp., Clifton, NJ (US)

(72) Inventors: Alexander Crudo, Hoboken, NJ (US); Yehuda Freundlich, Passaic, NJ (US)

(73) Assignee: NPS Public Furniture Corp., Clifton, NJ (US)

( * ) Notice: Subject to any disclaimer, the term of this patent is extended or adjusted under 35 U.S.C. 154(b) by 0 days.

(21) Appl. No.: 18/405,118

(22) Filed: Jan. 5, 2024

(51) Int. Cl.
*A47B 13/08* (2006.01)
*A47B 13/00* (2006.01)
*A47B 13/02* (2006.01)

(52) U.S. Cl.
CPC ..... *A47B 13/083* (2013.01); *A47B 13/003* (2013.01); *A47B 13/021* (2013.01)

(58) Field of Classification Search
CPC ... A47B 13/083; A47B 13/003; A47B 13/021; A47B 13/02; A47B 13/06
See application file for complete search history.

(56) References Cited

U.S. PATENT DOCUMENTS 3,590,754 A * 7/1971 Jakobsen ..... A47B 13/083 52/800.11
5,622,120 A * 4/1997 Yeh ..... A47B 13/021 108/158
2004/0237855 A1* 12/2004 Zhurong ..... A47B 13/021 108/115
2010/0071599 A1* 3/2010 McEntire ..... A47B 13/02 108/50.11
2015/0157123 A1* 6/2015 Tsai ..... A47B 3/087 108/115
2019/0090627 A1* 3/2019 Lim ..... F16B 12/48
2021/0018028 A1* 1/2021 Hutson ..... F16B 12/10
2021/0177138 A1* 6/2021 Leng ..... A47B 13/083

OTHER PUBLICATIONS

"LOBO Tables," https://wibenchmfg.com/products/tables/work-tables/lobo-tables/, WB Manufacturing, Retrieved on Dec. 19, 2023.
"Heavy Duty Designer Tables," https://res.cloudinary.com/da3rom333/image/upload/v1699033710/Product%20Assets/Literature/Sell%20Sheets/SellSheet_NPS_Heavy_Duty_Designer_Tables_Series_iaadd7.pdf, National Public Seating, Retrieved on Dec. 19, 2023.
"Planner Trespa: 30' x 60' Science Table Model #: 11288," https://smithsystem.com/wp-content/uploads/2017/09/ss_11288trespa_2018.pdf, Smith System, Jun. 2018.

* cited by examiner

*Primary Examiner* — Daniel J Rohrhoff
(74) *Attorney, Agent, or Firm* — Weiss & Arons LLP

(57) ABSTRACT

Methods, apparatus and systems for a heavy-duty table apron. The heavy-duty table may include a tabletop, a plurality of table legs and a plurality of table supports. Each of the table legs may be disposed at a corresponding corner of the tabletop. Each of the table supports may include an apron support and two apron ends. The apron support may include sheet metal and may be configured to be mounted on a bottom side of the tabletop. Each of the two apron ends may include angular metal tubing and an apron end cover configured to be welded to an open curved side of the metal tubing. One of the apron ends may be configured to be welded to one end of the apron support. The other one of the apron ends may be configured to be welded to an opposite end of the apron support.

20 Claims, 28 Drawing Sheets

HEAVY-DUTY DESIGNER TABLE APRON

FIELD OF TECHNOLOGY

Aspects of the disclosure relate to functional mechanical designs and apparatus. Specifically, aspects of the disclosure relate to heavy-duty tables with improved support designs.

BACKGROUND OF THE DISCLOSURE

Heavy-duty tables are designed to provide additional support in order to carry heavy loads and endure excessive use over time. Heavy-duty tables are used in a variety of applications. Exemplary applications may relate to the workplace, the home, retail locations, office settings, educational locations, eateries, leisure, and any other imaginable application that may utilize furniture such as a heavy-duty table.

Typically, heavy-duty tables include a table support. The table support generally comprises a frame that is mounted to a tabletop of the heavy-duty table. The frame typically includes an apron. The apron usually extends significantly below the tabletop. Because the frame extends below the tabletop the frame may reduce clearance under the table. Because the frame extends below the tabletop, access under the table may be limited and the heavy-duty table may not comply with Americans with Disabilities Act ("ADA") standards.

It would be desirable, therefore, to provide apparatus, systems and methods for supporting heavy-duty tables without compromising on clearance under the table. It would be further desirable to provide a heavy-duty table that is ADA compliant while maintaining adequate support.

SUMMARY OF THE DISCLOSURE

Apparatus, methods and systems for supporting a table while enabling accessibility are provided. The apparatus may include an apron. The apron may include an apron support. The apron support may include sheet metal. The sheet metal of the apron support may have a height of no more than 6 millimeters ("mm"). The sheet metal of the apron support may have a width of about 25 mm. The use of the term "about" may refer to up to ±5% or less of all measurements set forth herein. The sheet metal may include 3-gauge steel. The apron support may be mounted on a bottom side of a tabletop. The apron support may be mounted between a first table leg and a second table leg.

The apron may include two apron ends. Each of the apron ends may include angular metal tubing having a first side surface, a second side surface, a bottom surface, a flat open end, a curved open end, and two top edges. The angular metal tubing may include 13.5-gauge steel. Each of the apron ends may include an apron end cover. The apron end cover may be welded to the first side surface, the second side surface, and the bottom surface of the apron end. Following the welding the apron end cover may convert the curved open end to a curved closed end. The apron end cover may include a convex upward portion, a convex downward portion, and a middle portion. The middle portion may be curved at a 60° angle with respect to the two top edges of the apron end. The curve of the middle portion may define a change in height of the apron end from about 44 mm to about 2 mm.

The two top edges of a first apron end may be welded to a first end of the apron support with the flat open end of the first apron end configured to be disposed adjacent the first table leg. The two top edges of a second apron end may be welded to a second end of the apron support with the flat open end of the second apron end disposed adjacent the second table leg. Each apron may support the tabletop.

The apparatus may include four aprons. The four aprons may be mounted to a heavy-duty table. The heavy-duty table may include a tabletop. The tabletop may include four corners. The heavy-duty table may include four table legs. Each of the four table legs may correspond to one of the four corners. Each of the four of table legs may include a first inner side and a second inner side. The first inner side and second inner side may intersect at a 90° angle. Each of the four aprons may be mounted to a bottom side of the tabletop. Each of the four aprons may be mounted to a bottom side of the tabletop using screws. Each of the four aprons may be mounted between the first inner side of one table leg and the second inner side of another table leg. Two of the four aprons may have a first length. Two of the four aprons may have a second length. Each of the four aprons may support the tabletop.

The heavy-duty table may include four corner brackets. Each of the four corner brackets may be mounted to a table leg, an apron end from a first apron disposed adjacent a first inner side of the table leg, and an apron end from a second apron disposed adjacent a second inner side of the table leg.

BRIEF DESCRIPTION OF THE DRAWINGS

The objects and advantages of the disclosure will be apparent upon consideration of the following detailed description, taken in conjunction with the accompanying drawings, in which like reference characters refer to like parts throughout, and in which.

Figure 1:
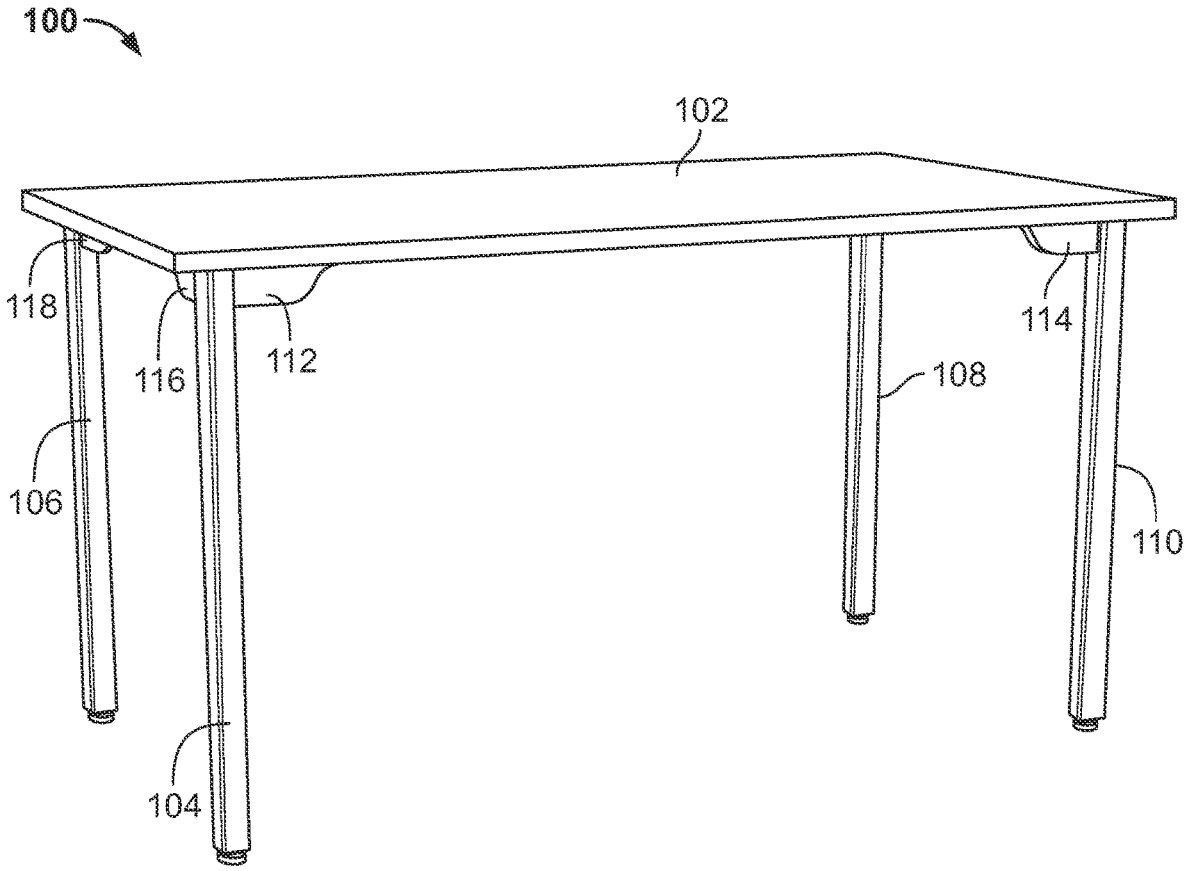
FIG. 1 shows an illustrative apparatus in accordance with principles of the disclosure.

The leftmost digit (e.g., "L") of a three-digit reference numeral (e.g., "LRR"), and the two leftmost digits (e.g., "LL") of a four-digit reference numeral (e.g., "LLRR"), generally identify the first figure in which a part is called-out.

DETAILED DESCRIPTION OF THE DISCLOSURE

A heavy-duty table with accessibility enabling support is provided. The heavy-duty table may include a tabletop. The tabletop may include a plurality of corners. The tabletop may be rectangular. The tabletop may be hexagonal, octagonal, square, or any suitable tabletop shape. The tabletop may be made partly or wholly out of a material. Table 1 shows illustrative materials that may include the material of the tabletop.

TABLE 1

| Illustrative tabletop materials. Illustrative tabletop materials. |
|---|
| Wood |
| Plastic |
| Metal |
| Standard-high pressure laminate |
| Supreme-high pressure laminate |
| Whiteboard |
| Chem-res |
| Phenolic |
| Trespa |
| Butcherblock |
| Any other suitable materials |
| Any suitable combination thereof |

A size of the tabletop may be customizable. Table 2 shows illustrative tabletop lengths. Table 3 shows illustrative tabletop widths.

TABLE 2

| Illustrative tabletop lengths. Illustrative tabletop lengths. |
|---|
| 24 inches |
| 30 inches |
| 36 inches |
| 42 inches |
| 48 inches |

TABLE 2-continued

| Illustrative tabletop lengths. Illustrative tabletop lengths. |
|---|
| 54 inches |
| 60 inches |
| 72 inches |
| Any other suitable length |

TABLE 3

| Illustrative tabletop widths. Illustrative tabletop widths. |
|---|
| 18 inches |
| 24 inches |
| 30 inches |
| Any other suitable width |

The heavy-duty table may include a plurality of table legs. The plurality of table legs may include steel. The plurality of table legs may include any other suitable material. Each of the table legs may be disposed at a corresponding one of the plurality of corners of the tabletop. For example, if a tabletop is a hexagonal shape, the heavy-duty table may include six legs, each of the six table legs may be disposed at a corner of the hexagonal tabletop.

The heavy-duty table may include a plurality of mounting brackets. Each of the mounting brackets may be welded to a respective one of the plurality of table legs. Each of the mounting brackets may be fixedly attached to a bottom side of the tabletop. Each of the mounting brackets may be screwed into the bottom side of the tabletop.

Each of the plurality of table legs may include a first inner side and a second inner side. Each of the plurality of table legs may include a first outer side and second outer side. The first inner side and second inner side may intersect at a 90° angle. The first outer side may intersect the first inner side at a 90° angle. The first outer side may intersect the second outer side at a 90° angle. The second outer side may intersect the second inner side at a 90° angle. The first and second inner sides may be the sides of the table leg that faces toward an area defined by the bottom side of the tabletop. The first and second outer sides may be the sides of the table leg that faces the away from the area defined by the bottom side of the tabletop.

In the some of the embodiments, the plurality of table legs may not include sides. The plurality of table legs may be circular.

The plurality of table legs may be height-adjustable table legs. The height-adjustable table legs may enable the adjustment of a height of the tabletop in relation to the ground. Table 4 shows illustrative ranges of the height of a table with height-adjustable legs (height, in relation to the adjustable table, is the height of the legs plus the height of tabletop).

TABLE 4

| Illustrative ranges of heights for the table with height-adjustable table legs. Illustrative ranges of heights for the table with height-adjustable table legs. |
|---|
| <20.25 |
| 20.25 inches-35.25 inches |
| 20.50 inches-35.50 inches |
| 20.75 inches-35.75 inches |

TABLE 4-continued

| Illustrative ranges of heights for the table with height-adjustable table legs. Illustrative ranges of heights for the table with height-adjustable table legs. |
|---|
| 21.00 inches-36.00 inches |
| 21.25 inches-36.25 inches |
| 21.50 inches-36.50 inches |
| 21.75 inches-36.75 inches |
| 22.00 inches-37.00 inches |
| 22.25 inches-37.25 inches |
| >37.25 |
| Other suitable height ranges |

The plurality of table legs may be fixed-height legs. The fixed-height table legs may define a height of the heavy-duty table. Table 5 shows illustrative ranges of the height of a table with fixed height (height, in relation to the adjustable table, is the height of the legs plus the height of tabletop).

TABLE 5

| Illustrative ranges of heights for the table with fixed-height table legs. Illustrative ranges of heights for the table with fixed-height table legs. |
|---|
| <27.0 |
| 27.0 inches-27.5 inches |
| 27.5 inches-28.0 inches |
| 28.0 inches-28.5 inches |
| 28.5 inches-29.0 inches |
| 29.0 inches-29.5 inches |
| 39.5 inches-30.0 inches |
| 30.0 inches-31.5 inches |
| 31.5 inches-32.0 inches |
| >32.0 |
| Other suitable height ranges |

The clearance under the heavy-duty table may be in compliance with dimensions specified under Americans with Disabilities Act ("ADA") standards. A table that complies with ADA standards may be required to have a surface height of no more than 34 inches and no less than 28 inches above the floor. A table that complies with ADA standards may be required to provide at least 27 inches of knee clearance between the floor and an underside of the table. The knee clearance may be required to extend 19 inches under the table.

The height of the heavy-duty table may not be less than a predetermined minimum and not be greater than a predetermined maximum. As such, clearance under the heavy-duty table may be in line with ADA standards. Table 6 shows illustrative ranges of heights of the heavy-duty table that may include the predetermined minimum and the predetermined maximum heights.

TABLE 6

| Illustrative ranges of height of the heavy-duty table. Illustrative ranges of clearance under the heavy-duty table. |
|---|
| 28 inches-30 inches |
| 28 inches-31 inches |
| 28 inches-32 inches |
| 28 inches-33 inches |
| 28 inches-34 inches |
| Other suitable height ranges |

The heavy-duty table may include a plurality of aprons. The plurality of aprons may be table supports. Each of the plurality of aprons may include an apron support. The apron support may include sheet metal. The sheet metal may include 3-gauge steel. The sheet metal may include any other suitable gauge steel. The sheet metal may include any suitable material. Table 7 shows illustrative ranges of the height of the apron support. Table 8 shows illustrative ranges of the width of the apron support.

TABLE 7

| Illustrative ranges of the height of the apron support. Illustrative ranges of the height of the apron support |
|---|
| <1 mm |
| 1 mm-2 mm |
| 2 mm-3 mm |
| 3 mm-4 mm |
| 4 mm-5 mm |
| 5 mm-6 mm |
| 6 mm-7 mm |
| >7 mm |
| Other suitable height ranges |

TABLE 8

| Illustrative ranges of the width of the apron support. Illustrative ranges of the width of the apron support |
|---|
| 10 mm-15 mm |
| 15 mm-20 mm |
| 20 mm-25 mm |
| 25 mm-30 mm |
| 30 mm-35 mm |
| 35 mm-40 mm |
| Other suitable width ranges |

The apron support may be mounted to a bottom side of the tabletop. The apron support may be mounted between an inner side of a first table leg and an inner side of a second table leg. The apron support may be mounted to the bottom side of the tabletop using screws.

Each of the aprons may include two apron ends. Each of the two apron ends may include angular metal tubing. The angular metal tubing may include 13.5-gauge steel. The angular metal tubing may include any other suitable gauge steel. The angular metal tubing may include any other suitable material. Each of the apron ends may include a first side surface. Each of the apron ends may include a second side surface. The first side surface may be parallel to the second side surface. Each of the apron ends may include a bottom surface. The bottom surface may connect to a bottom edge of the first side surface and a bottom edge of the second side surface.

Each of the apron ends may include a flat open end. The flat open end may be defined by an intersection of the first side surface, the second side surface and the bottom surface. Each of the apron ends may include a curved open end. The curved open end may be opposite the flat open end. The curved open end may be defined by a curved end of the first side surface, a curved end of the second side surface and an edge of the bottom surface. Each of the apron ends may include a top side. The top side may be parallel with the bottom surface. The top side may be an open side defined by a top edge of the first side surface and a top edge of the second side surface.

Each of the two apron ends may include an apron end cover. The apron end cover may be welded to the curved end of the first side surface, the curved end of the second side surface, and an edge of the bottom surface. Following the welding, the apron end cover may convert the curved open end to a curved closed end.

The apron end cover may include a convex upward portion. The apron end cover may include a convex downward portion. The apron end cover may include a middle portion. The middle portion may be curved at an angle with respect to the two top edges of the apron end. Table 9 shows illustrative curve angle ranges of the middle portion of the apron end.

TABLE 9

| Illustrative curve angles.<br>Illustrative curve angles. |
|---|
| <30° |
| 30°-45° |
| 45°-60° |
| 60°-75° |
| 75°-90° |
| >90° |
| Other suitable angle ranges |

The curve of the middle portion defines a change in height of the apron end from about 44 millimeters to about 2 millimeters.

The apron end cover may be welded by each seam between the first side surface, the second side surface and the bottom surface. Following the welding the apron end cover may be sanded. Following the sanding the apron end may be powder coated.

One of the two apron ends may be welded to a first side of the apron support. The apron end may be welded with the flat open end disposed adjacent the inner side of the first table leg. The other one of the two apron ends may be welded to a second side of the apron support. The other one of the two apron ends may be welded with the flat open end disposed adjacent the inner side of the second table leg.

One of the two apron support may be welded to the apron support on one end of the apron support. The other one of the two apron ends may be welded to the other end of the apron support. The two apron ends may be disposed facing each other on opposite ends of the apron support. Each of the plurality of aprons may support the heavy-duty table.

The heavy-duty table may be a heavy-duty table that has a tabletop that includes four corners. The heavy-duty table may include four table legs. Each one of the four table legs may correspond to one of the four corners. Each one of the table legs may be mounted to one of the four corners. Each one of the table legs may include a mounting bracket. The mounting bracket may be screwed into the bottom side of the tabletop. The heavy-duty table may include four aprons. Each of the four aprons may be disposed between two table legs.

There may be a first distance between two table legs on a first side of the table. There may be a second distance between two table legs on a second side of the table. There may be a third distance between two table legs on a third side of the table. There may be a fourth distance between two table legs on a fourth side of the table. A length of the first distance and a length of the third distance may be the same length. A length of the second distance and a length of the fourth distance may be the same length. Accordingly, two of the four aprons may have a first length. The first length may be the same length as the length of the first and third distances. Two of the four aprons may have a second length. The second length may be the same length as the length of the second and fourth distances.

In another embodiment, the length of the first distance, the length of the second distance, the length of the third distance and the length of the fourth distance may be the same length. Accordingly, all of the four aprons may have the same length. The length of the four aprons may be the same length as the length of the first, second, third and fourth distances.

Each of the four aprons may support the tabletop.

The heavy-duty table may include four corner brackets. Each of the four corner brackets may be mounted to a table leg, an apron end from a first apron disposed adjacent a first inner side of the table leg, and an apron end from a second apron disposed adjacent a second inner side of the table leg. The corner bracket may be mounted to the table leg and two apron ends with screws. The first side surface of each apron end may include two tapped holes. The two tapped holes may be threaded. The two tapped holes may be configured to accept screws from the corner bracket.

Apparatus and methods described herein are illustrative. Apparatus and methods in accordance with this disclosure will now be described in connection with the figures, which form a part hereof. The figures show illustrative features of apparatus and method steps in accordance with the principles of this disclosure. It is understood that other embodiments may be utilized, and that structural, functional, and procedural modifications may be made without departing from the scope and spirit of the present disclosure.

As used herein in FIGS. 16A-26D, "mm" may refer to millimeters.

FIG. 1 shows illustrative heavy-duty table 100. Heavy-duty table 100 may include tabletop 102. Heavy-duty table 100 may include table legs 110, 108, 106 and 104. Each of table legs 110, 108, 106 and 104 may be mounted to a corner of tabletop 102. Heavy-duty table 100 may include apron ends 112 and 114. Apron ends 112 and 114 may be welded to an apron support (not shown). Apron ends 112 and 114 and the corresponding apron support may be disposed between table legs 104 and 110. Heavy-duty table 100 may include apron ends 116 and 118. Apron ends 116 and 118 may be welded to an apron support (not shown). Apron ends 116 and 118 and the corresponding apron support may be disposed between table legs 104 and 106. Heavy-duty table 100 may include two apron ends and a corresponding apron support disposed between the table legs on each side of the table.

Figure 2:
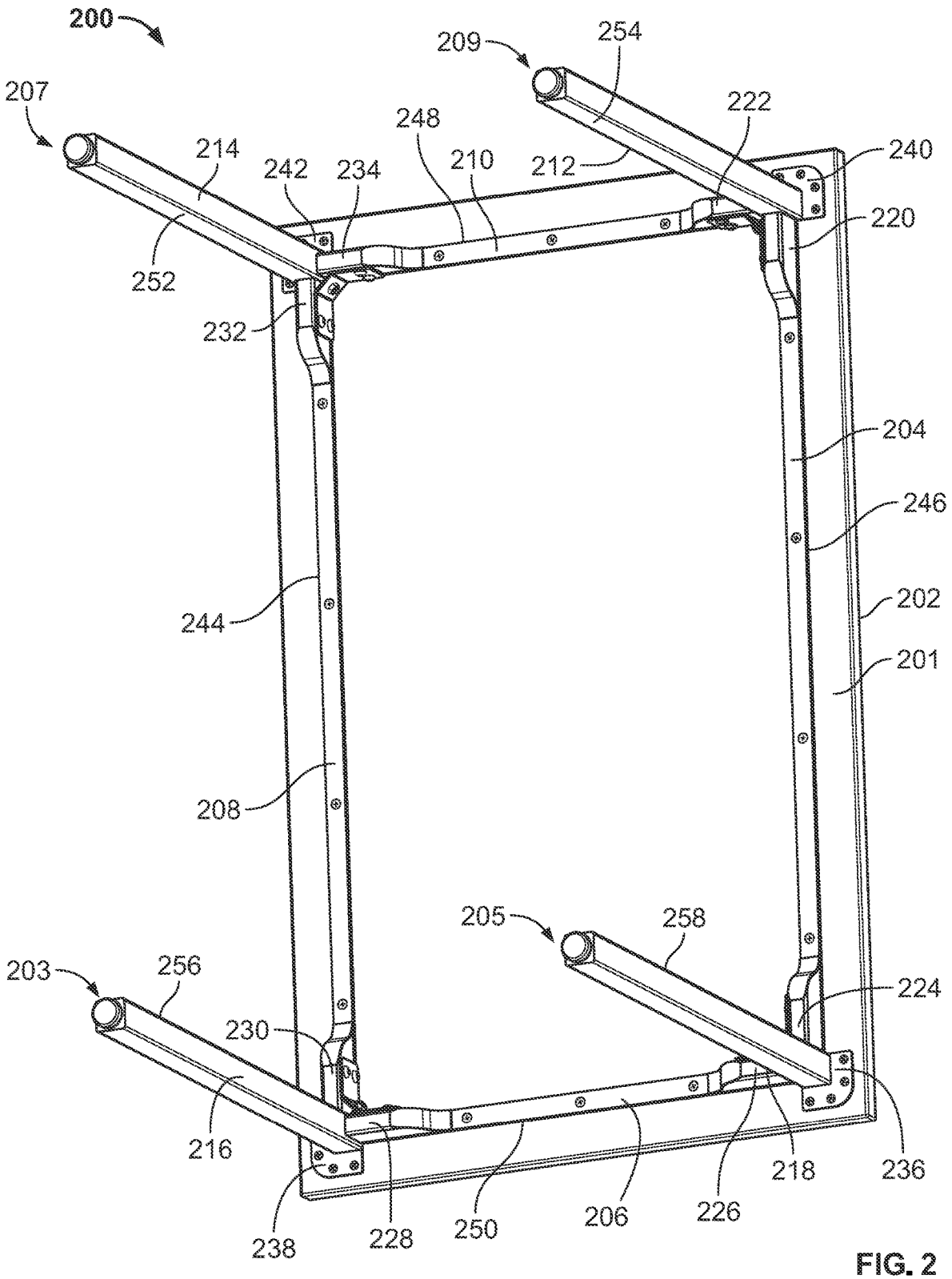
FIG. 2 shows another illustrative apparatus in accordance with principles of the disclosure.

FIG. 2 shows illustrative heavy-duty table 200. Heavy-duty table 200 may have one or more feature in common with heavy-duty table 100.

Heavy-duty table 200 may include tabletop 202. Tabletop 202 may include tabletop bottom 201. Table legs 203, 205, 207 and 209 may be mounted to tabletop bottom 201. Table legs 203, 205, 207 and 209 may be mounted to tabletop bottom 201 using mounting brackets 238, 236, 242 and 240 respectively. Table legs 203, 205, 207 and 209 may be mounted to tabletop bottom 201 by screwing mounting brackets 238, 236, 242 and 240 into tabletop bottom 201.

Heavy-duty table 200 may include aprons 244, 246, 248 and 250. Aprons 244 and 246 may have a first length. Aprons 248 and 250 may have a second length.

Apron 244 may include apron support 208, apron end 230 and apron end 232. Apron ends 230 and 232 may be welded to opposite ends of apron support 208. Apron 244 may be mounted to tabletop bottom 201 between table leg 203 and table leg 207. Apron 244 may be mounted to tabletop bottom 201 between table leg 203 and table leg 207, using screws. An open end of apron end 232 may be disposed adjacent to inner side 252 of table leg 207. An open end of apron end 230 may be disposed adjacent inner side 256 of table leg 203.

Apron 246 may include apron support 204, apron end 220 and apron end 224. Apron ends 220 and 224 may be welded to apron support 204. Apron 246 may be mounted to tabletop bottom 201 between table leg 209 and table leg 205. Apron 246 may be mounted to tabletop bottom 201 between table leg 209 and table leg 205, using screws. An open end of apron end 220 may be disposed adjacent to inner side 254 of table leg 209. An open end of apron end 224 may be disposed adjacent inner side 258 of table leg 205.

Apron 248 may include apron support 210, apron end 222 and apron end 234. Apron ends 222 and 234 may be welded to apron support 210. Apron 248 may be mounted to tabletop bottom 201 between table leg 207 and table leg 209. Apron 248 may be mounted to tabletop bottom 201 between table leg 207 and table leg 209, using screws. An open end of apron end 222 may be disposed adjacent to inner side 212 of leg 209. An open end of apron end 234 may be disposed adjacent inner side 214 of table leg 207.

Apron 250 may include apron support 206, apron end 226 and apron end 228. Apron ends 226 and 228 may be welded to apron support 206. Apron 250 may be mounted to tabletop bottom 201 between table leg 205 and table leg 203. Apron 250 may be mounted to tabletop bottom 201 between table leg 205 and table leg 203, using screws. An open end of apron end 226 may be disposed adjacent to inner side 218 of table leg 205. An open end of apron end 228 may be disposed adjacent inner side 216 of table leg 203.

Figure 3:
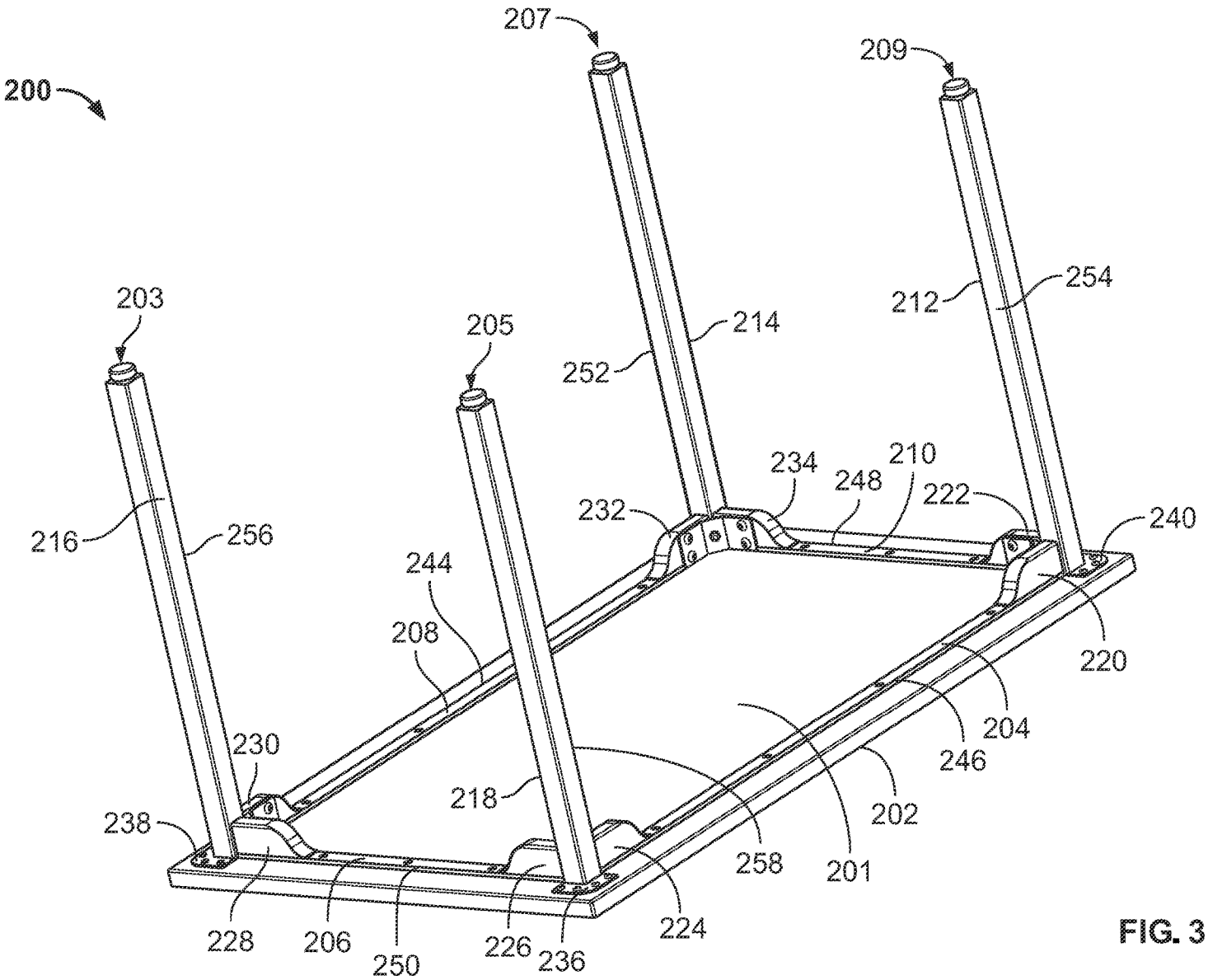
FIG. 3 shows yet another illustrative apparatus in accordance with principles of the disclosure.

FIG. 3 shows another view of heavy-duty table 200.

Figure 4:
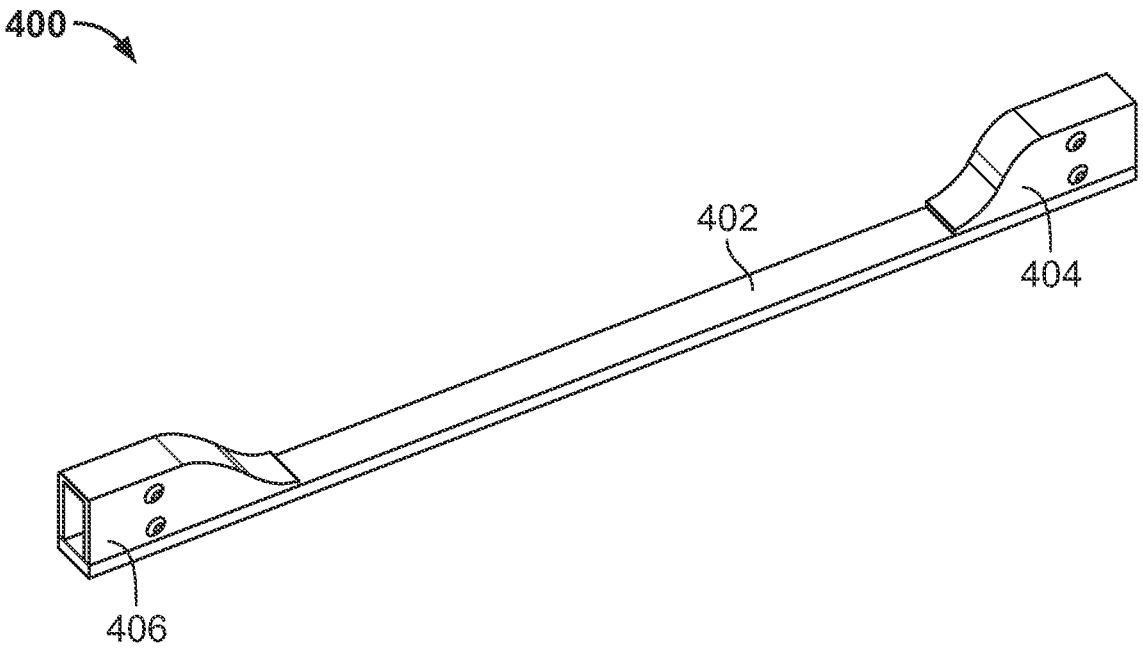
FIG. 4 shows still another illustrative apparatus in accordance with principles of the disclosure.

FIG. 4 shows illustrative apron 400. Apron 400 may have one or more features in common with one or more of the aprons as described in one or more of heavy-duty table 100 and heavy-duty table 200.

Apron 400 may include apron support 402. Apron 400 may include apron ends 406 and 404. Apron ends 406 and 404 may be welded to apron support 402. Apron support 402 may include tapped holes (not shown). The tapped holes may be configured to accept screws. Apron 400 may be mounted to a tabletop bottom by screwing screws through the tapped holes into the tabletop bottom. Apron ends 404 and 406 may be disposed between two table legs.

Figure 5:
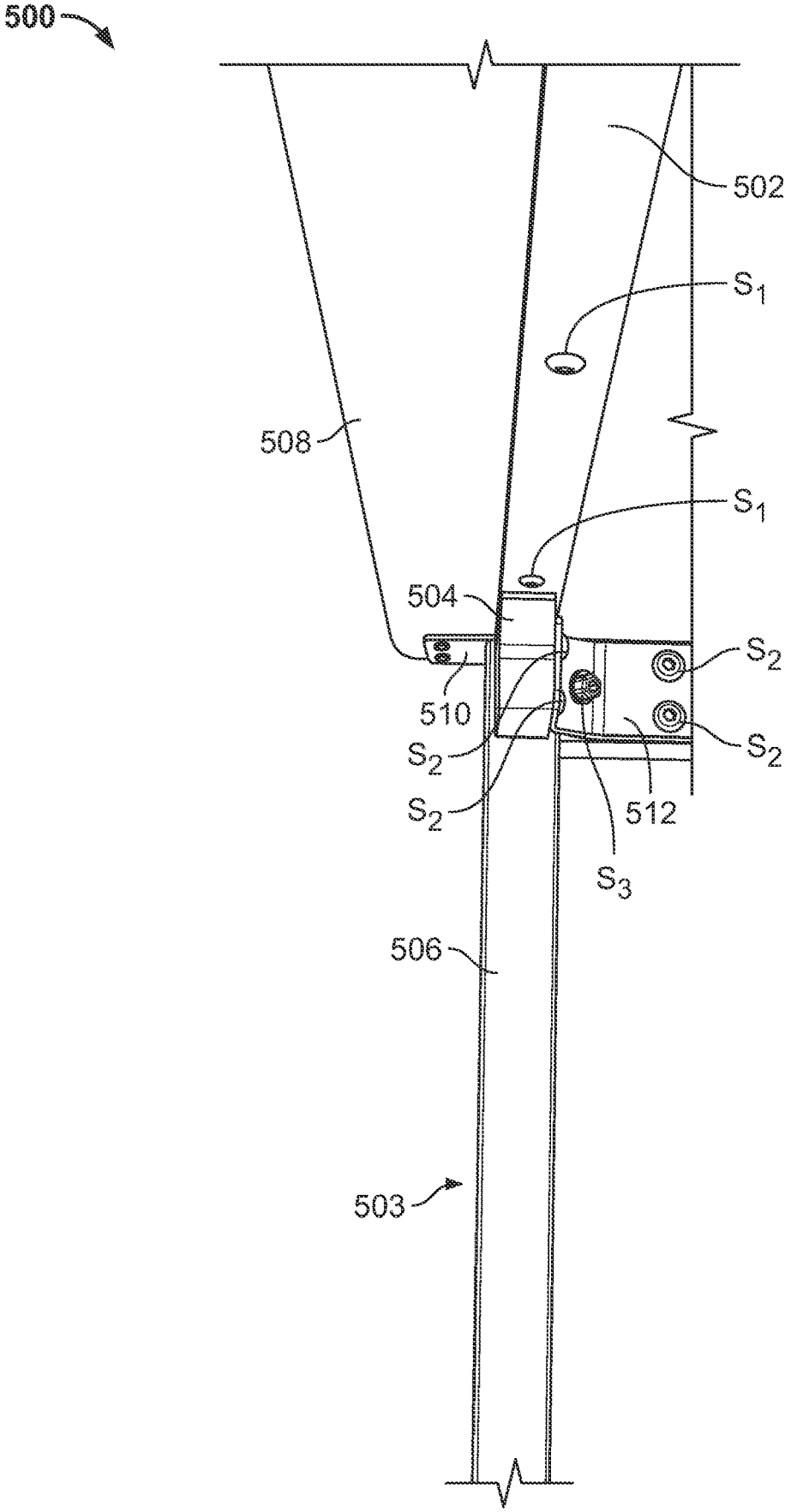
FIG. 5 shows an illustrative apparatus in accordance with principles of the disclosure.

FIG. 5 shows illustrative bottom view of heavy-duty table 500. Heavy-duty table 500 may have one or more features in common with one or more of heavy-duty tables 100 and 200.

Apron support 502 may be mounted to tabletop bottom 508. Apron support 502 may be mounted to tabletop bottom 508 using screws $S_1$. Apron end 504 may be welded to apron support 502. Apron end 504 may be disposed adjacent inner side 506 of table leg 503. Table leg 503 may be mounted to tabletop bottom 508 via mounting bracket 510. Corner bracket 512 may be affixed to apron end 504 table leg 503, and an apron end of a second apron support (not shown). Corner bracket 512 may be affixable to apron end 504 and the apron end of the second apron end via mounting screws $S_2$. Corner bracket 512 may be affixable to table leg 503 via nut $S_3$.

Figure 6:
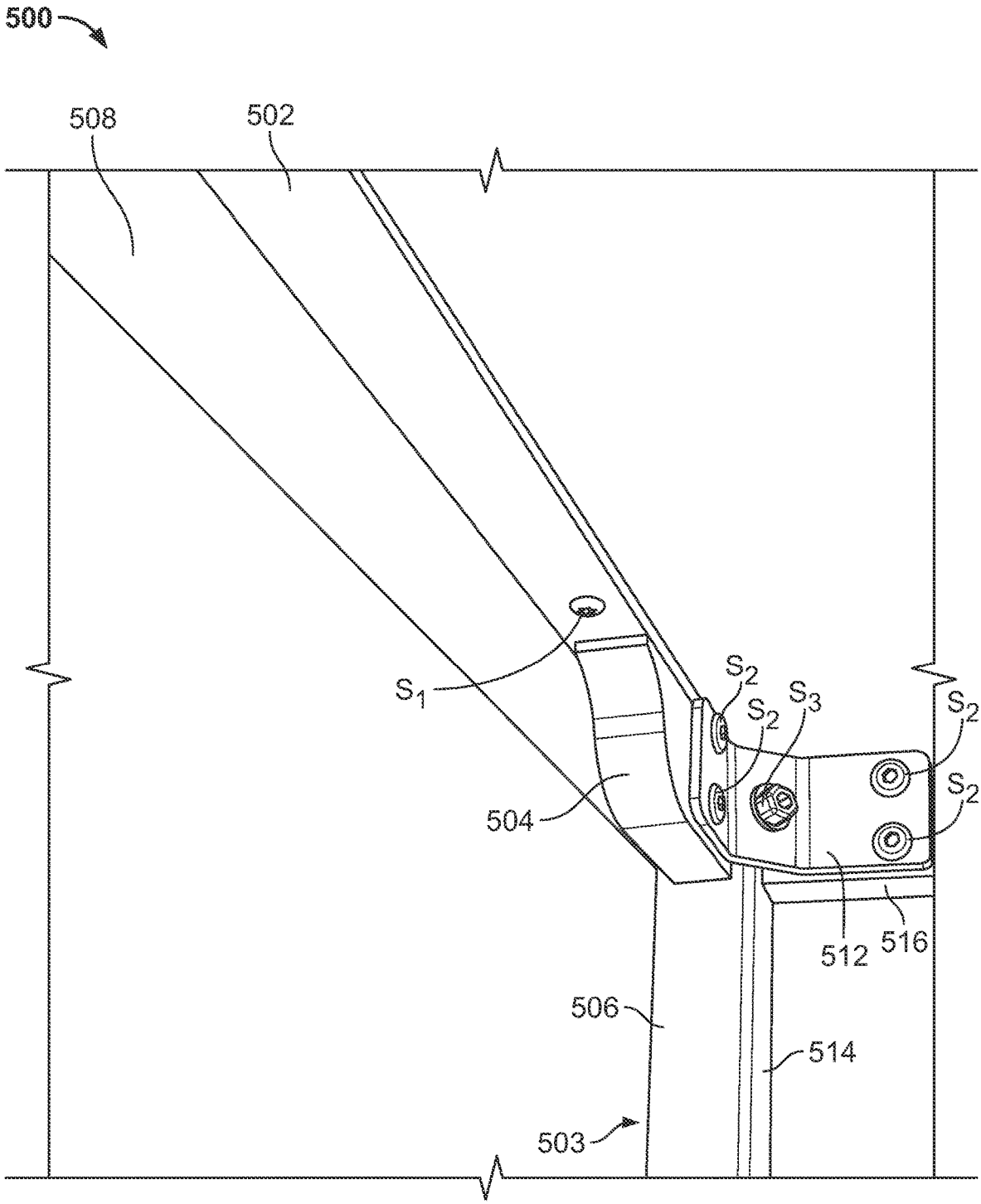
FIG. 6 shows another illustrative apparatus in accordance with principles of the disclosure.

FIG. 6 shows another view of heavy-duty table 500. The second apron may include apron end 516. Apron end 516 may be disposed adjacent inner side 514 of table leg 503. Inner sides 506 and 514 may intersect. Corner bracket 512 may connect apron end 504, table leg 503 and apron end 504. Corner bracket 512 may provide an additional level of support to heavy-duty table 500.

Figure 7:
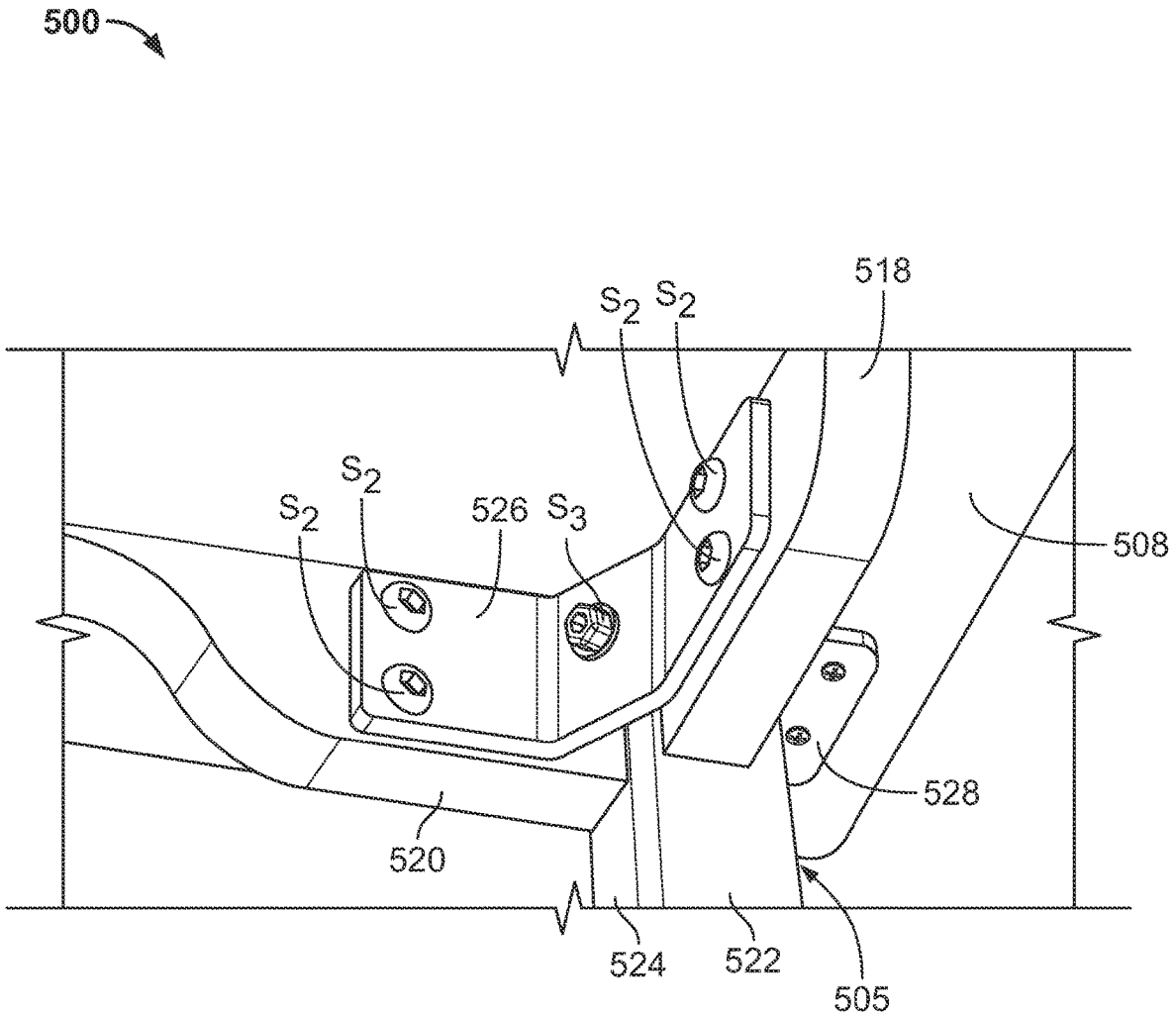
FIG. 7 shows yet another illustrative apparatus in accordance with principles of the disclosure.

FIG. 7 shows another view of heavy-duty table 500. Apron end 518 may be disposed adjacent inner side 522 of table leg 505. Table leg 505 may be mounted to tabletop bottom 508 via mounting bracket 528. Apron end 520 may be disposed adjacent inner side 524 of table leg 505. Inner sides 522 and 524 may intersect. Corner bracket 526 may be affixed to apron end 518 table leg 505, and apron end 520. Corner bracket 526 may be affixable to apron end 518 and apron end 520 via mounting screws $S_2$. Corner bracket 526 may be affixable to table leg 505 via nut $S_3$. Corner bracket 526 may provide an additional level of support to heavy-duty table 500.

Figure 8:
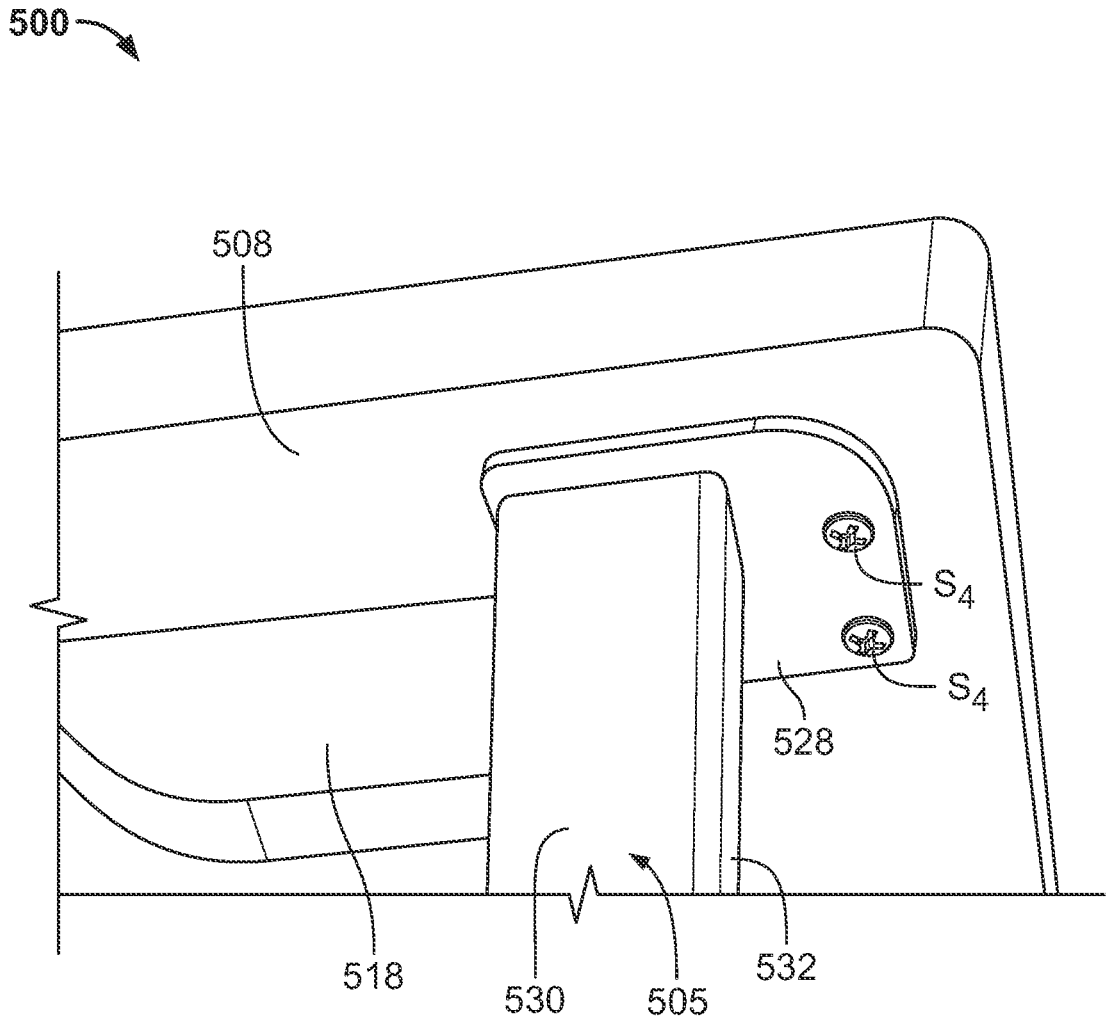
FIG. 8 shows still another illustrative apparatus in accordance with principles of the disclosure.

FIG. 8 shows another view of heavy-duty table 500. Table leg 505 may include outer sides 530 and 532. Outer sides 530 and 532 may intersect. Outer sides 530 and 532 may intersect with inner sides 522 and 524 (as shown in FIG. 7). Table leg 505 may be mounted to tabletop bottom 508 by screwing mounting bracket 528 into tabletop bottom 508 using mounting screws $S_4$.

Figure 9:
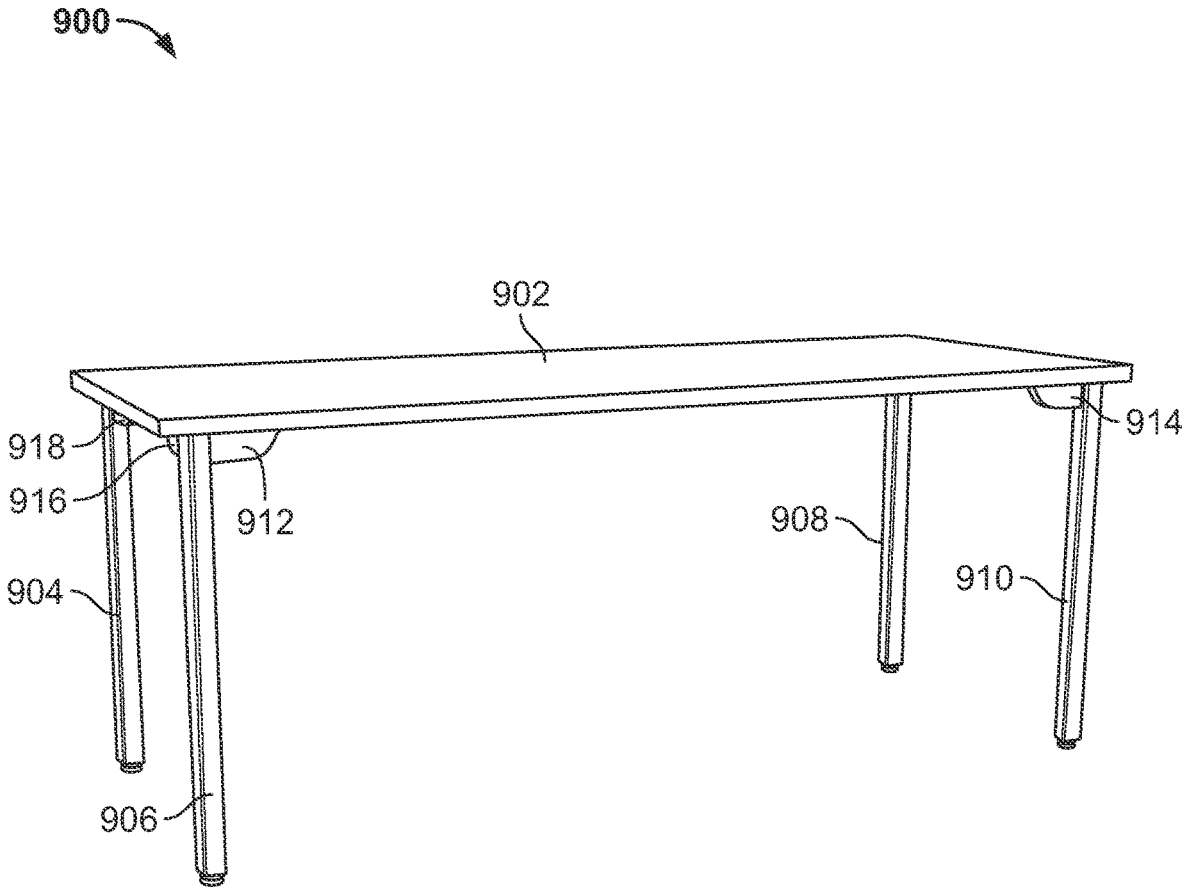
FIG. 9 shows an illustrative apparatus in accordance with principles of the disclosure.

FIG. 9 shows illustrative view of heavy-duty table 900. Heavy-duty table 900 may have one or more features in common with one or more of heavy-duty tables 100, 200 and 500.

Heavy-duty table 900 may include tabletop 902. Heavy-duty table 900 may include table legs 904, 906, 908 and 910. Each of table legs 904, 906, 908 and 910 may be mounted to a corner of tabletop 902. Table legs 904, 906, 908 and 910 may have a fixed height. Table legs 904, 906, 908 and 910 may be legs that are not adjustable. Clearance under heavy-duty table 900 may be fixed. The height of heavy-duty table 900 with fixed height legs may be included in the range of table heights listed in Table 5 (above).

Heavy-duty table 900 may include apron ends 912 and 914. Apron ends 912 and 914 may be welded to an apron support (not shown). Apron ends 912 and apron ends 914 and the corresponding apron support may be disposed in between table legs 906 and 910. Heavy-duty table 900 may include apron ends 916 and 918. Apron ends 916 and 918 may be welded to an apron support (not shown). Apron ends 916 and 918 and the corresponding apron support may be disposed in between table legs 904 and 906.

Figure 10:
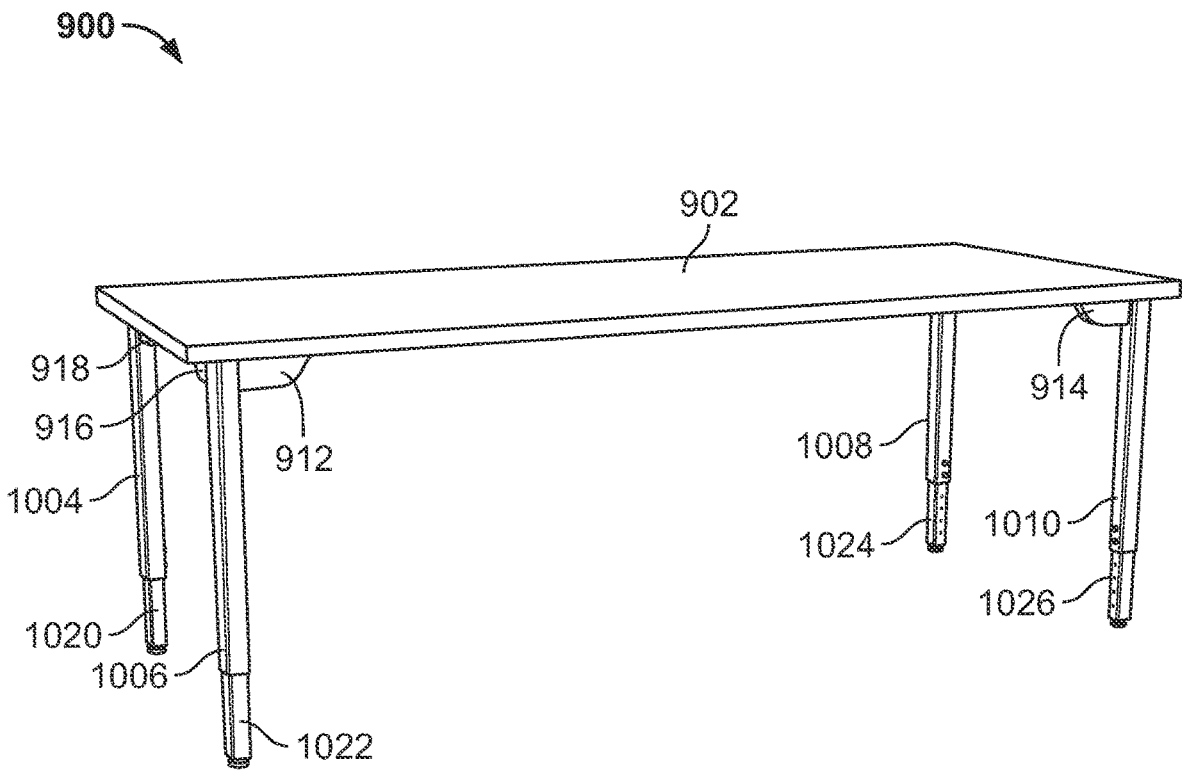
FIG. 10 shows another illustrative apparatus in accordance with principles of the disclosure.

FIG. 10 shows another embodiment of heavy-duty table 900. Heavy-duty table 900 may include table legs 1004, 1006, 1008 and 1010. Table legs 1004, 1006, 1008 and 1010 may be adjustable legs. Table legs 1004, 1006, 1008 and 1010 may be table legs that do not have a fixed height. Table leg 1004 may include adjustable segment 1020. Adjustable segment 1020 may be manually adjusted to change the height of table leg 1004. Table leg 1006 may include adjustable segment 1022. Adjustable segment 1022 may be manually adjusted to change the height of table leg 1006. Table leg 1008 may include adjustable segment 1024. Adjustable segment 1024 may be manually adjusted to change the height of table leg 1008. Table leg 1010 may include adjustable segment 1026. Adjustable segment 1026 may be manually adjusted to change the height of table leg 1010. Clearance under heavy-duty table 900 may dynamically change with adjustments of the height of table legs 1004, 1006, 1008, and 1010. The height of heavy-duty table 900 with adjustable table legs may be included in the range of table heights listed in Table 4 (above).

In the adjustable configuration, apron ends 912 and apron ends 914 and the corresponding apron support may be disposed in between table legs 1006 and 1010. Apron ends 916 and 918 and the corresponding apron support may be disposed in between table legs 1004 and 1006.

Figure 11:
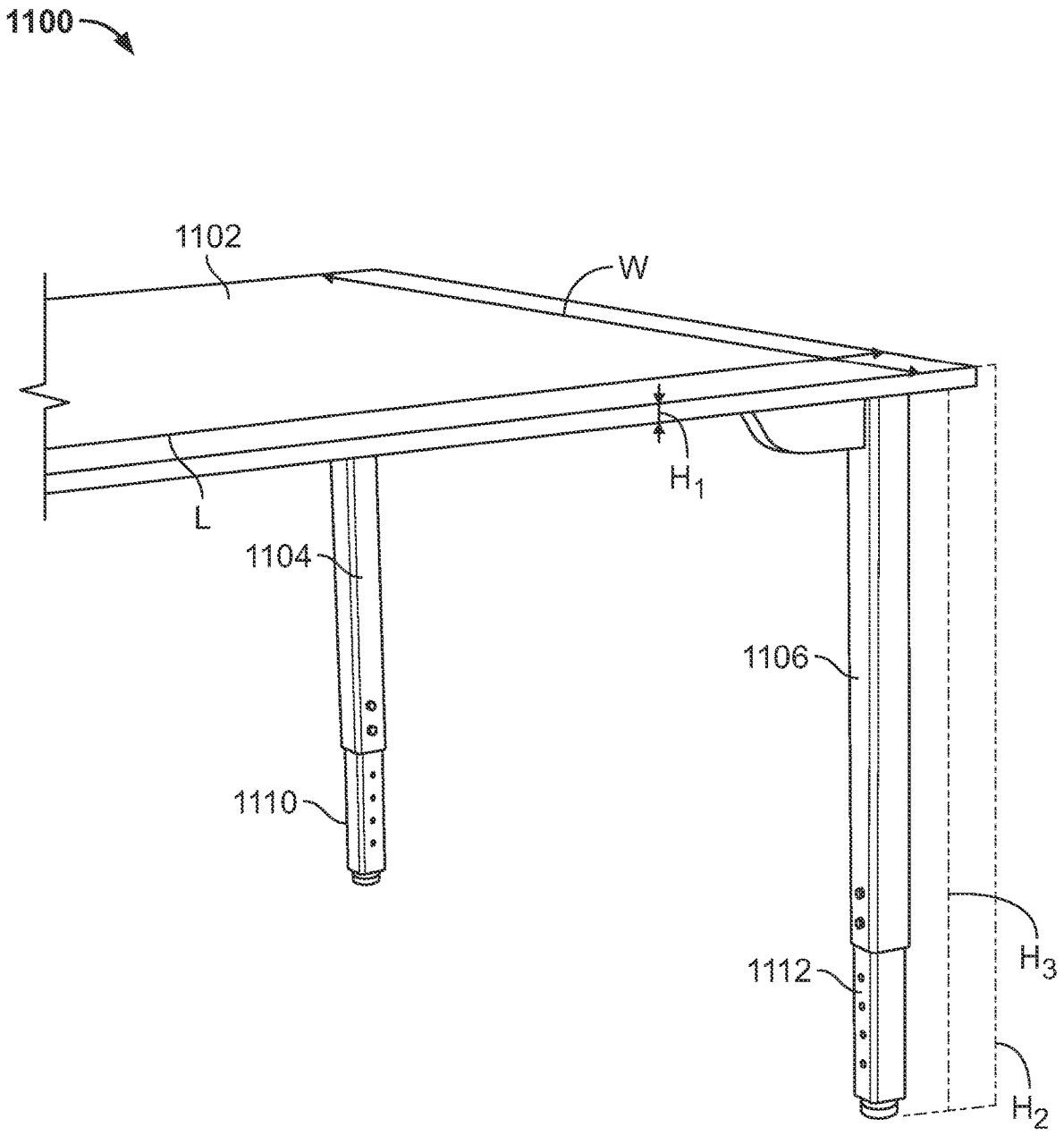
FIG. 11 shows another illustrative apparatus in accordance with principles of the disclosure.

FIG. 11 shows illustrative view of heavy-duty table 1100. Heavy-duty table 1100 may have one or more features in common with one or more of heavy-duty tables 100, 200, 500 and 900.

Heavy-duty table 1100 may include tabletop 1102. Tabletop 1102 may have a length L. Length L may be any suitable length listed in Table 2 (above). Tabletop 1102 may have a width W. Width W may be any suitable width listed in Table 3 (above). Tabletop 1102 may include a height $H_1$. Height $H_1$ may be any suitable height of a tabletop. Length L, width W, and height $H_1$ may vary. Length L, width W, and height $H_1$ may be customizable.

Heavy-duty table 1100 may include table legs 1104 and 1106. Table legs 1104 and 1106 may be height-adjustable legs. Table leg 1104 may include adjustable segment 1110. Table leg 1106 may include adjustable segment 1112. Table legs 1104 and 1106 may be adjustable by adjusting adjustable segment 1110 and 1112. $H_3$, the height of table legs 1104 and 1106, in addition to $H_1$ may define the height, $H_2$, of heavy-duty table 1100. Height $H_2$ may be any height included in the range of heights listed in Table 4 (above).

Figure 12:
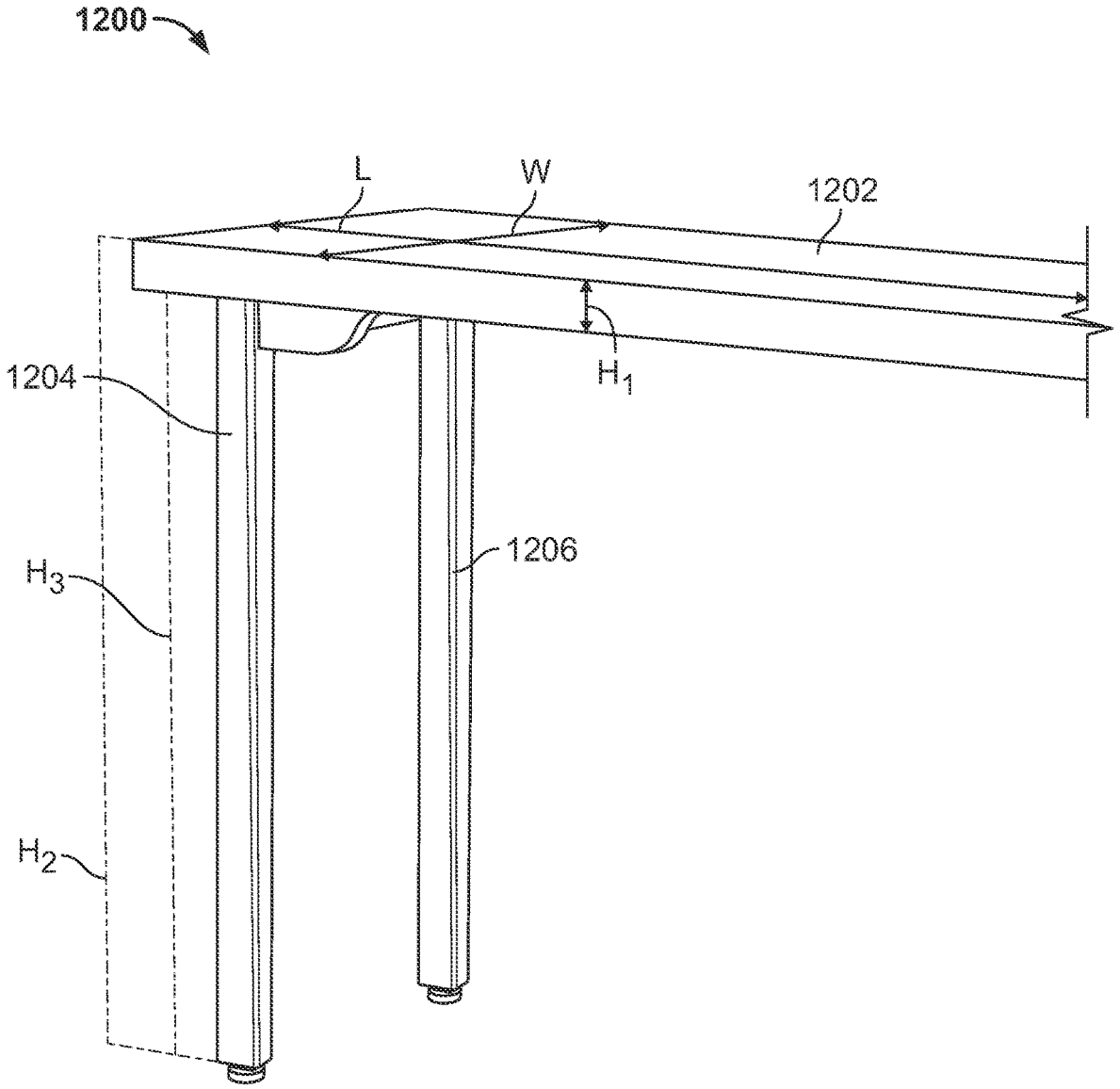
FIG. 12 shows another illustrative apparatus in accordance with principles of the disclosure.

FIG. 12 shows illustrative view of heavy-duty table 1200. Heavy-duty table 1200 may have one or more features in common with one or more of heavy-duty tables 100, 200, 500 and 900.

Heavy-duty table 1200 may include tabletop 1202. Tabletop 1202 may have a length L. Length L may be any suitable length listed in Table 2 (above). Tabletop 1202 may have a width W. Width W may be any suitable width listed in Table 3 (above). Tabletop 1202 may include a height $H_1$. Height $H_1$ may be any suitable height of a tabletop. Length L, width W, and height $H_1$ may vary. Length L, width W, and height $H_1$ may be customizable.

Heavy-duty table 1200 may include table legs 1204 and 1206. Table legs 1204 and 1206 may be fixed-height legs. $H_3$, the height of table legs 1204 and 1206, in addition to $H_1$ may define the height, $H_2$, of heavy-duty table 1200. Height $H_2$ may be any height included in the range of heights listed in Table 5 (above).

Figure 13:
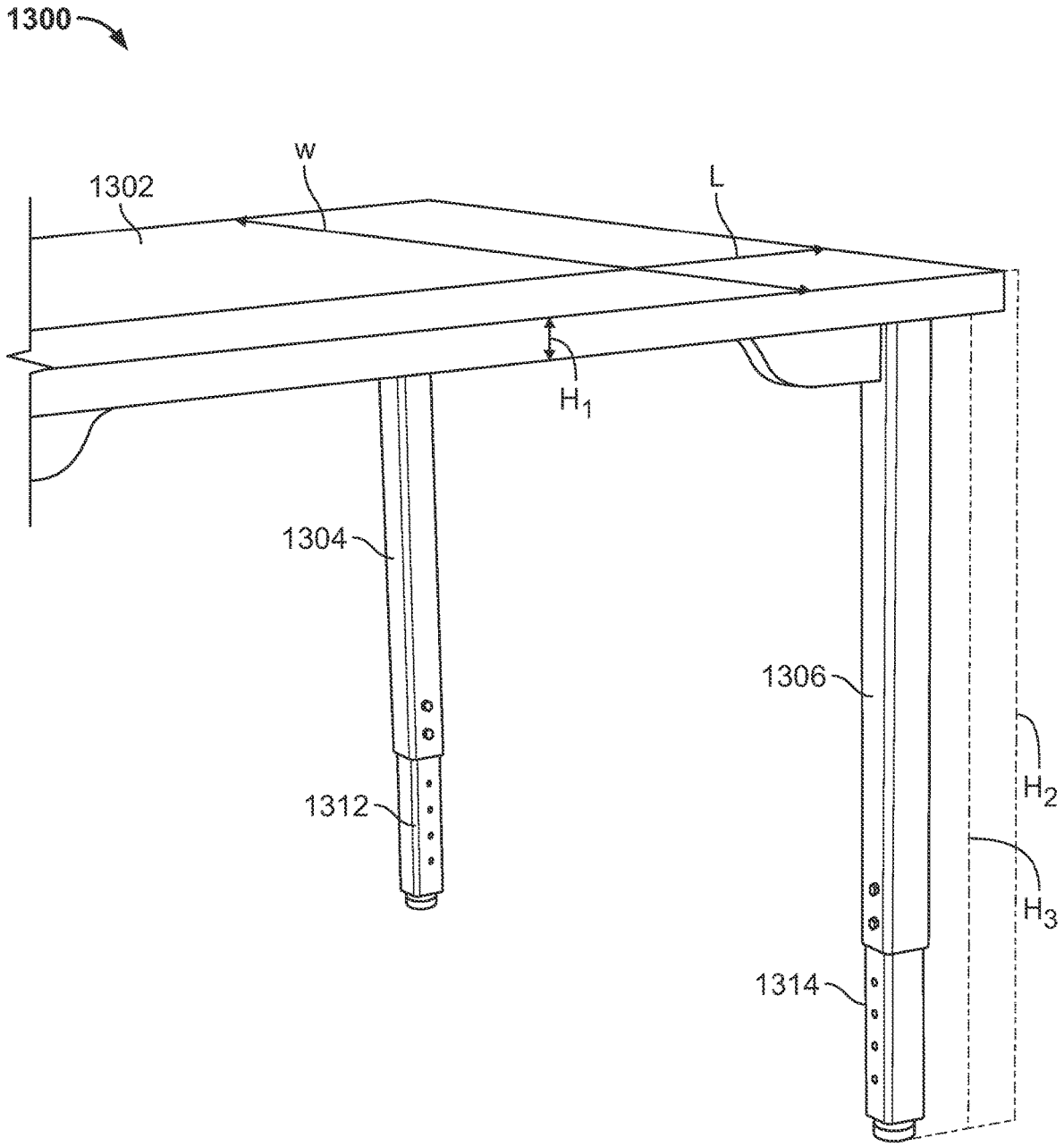
FIG. 13 shows another illustrative apparatus in accordance with principles of the disclosure.

FIG. 13 shows illustrative view of heavy-duty table 1300. Heavy-duty table 1300 may have one or more features in common with one or more of heavy-duty tables 100, 200, 500 and 900.

Heavy-duty table 1300 may include tabletop 1302. Tabletop 1302 may have a length L. Length L may be any suitable length listed in Table 2 (above). Tabletop 1302 may have a width W. Width W may be any suitable width listed in Table 3 (above). Tabletop 1302 may include a height $H_1$. Height $H_1$ may be any suitable height of a tabletop. Length L, width W, and height $H_1$ may vary. Length L, width W, and height $H_1$ may be customizable.

Heavy-duty table 1300 may include table legs 1304 and 1306. Table legs 1304 and 1306 may be height-adjustable legs. Table leg 1304 may include adjustable segment 1312. Table leg 1306 may include adjustable segment 1314. Table legs 1304 and 1306 may be adjustable by adjusting adjustable segment 1312 and 1314. $H_3$, the height of table legs 1304 and 1306, in addition to $H_1$ may define the height, $H_2$, of heavy-duty table 1300. Height $H_2$ may be any height included in the range of heights listed in Table 4 (above).

Figure 14:
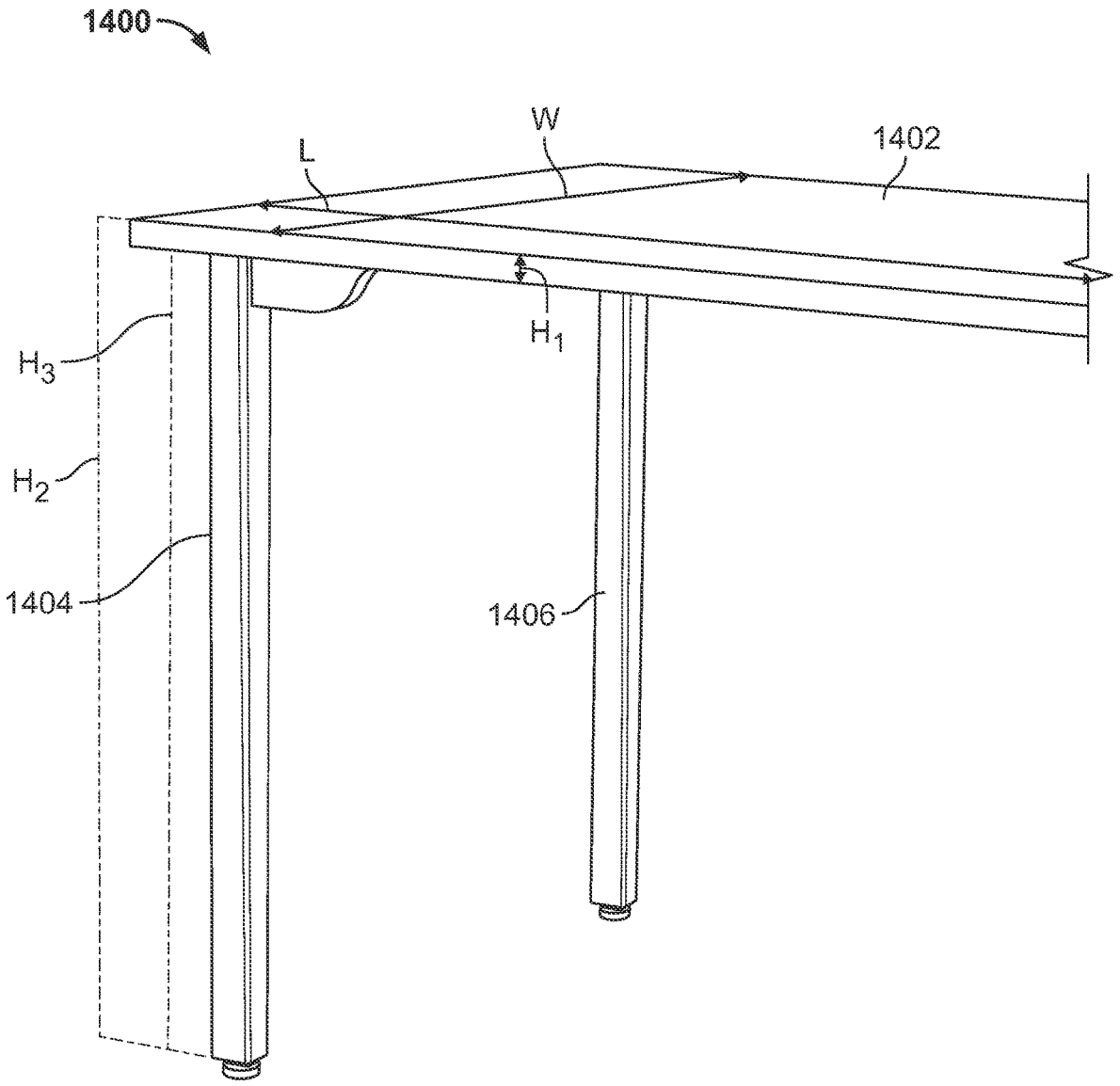
FIG. 14 shows another illustrative apparatus in accordance with principles of the disclosure.

FIG. 14 shows illustrative view of heavy-duty table 1400. Heavy-duty table 1400 may have one or more features in common with one or more of heavy-duty tables 100, 200, 500 and 900.

Heavy-duty table 1400 may include tabletop 1402. Tabletop 1402 may have a length L. Length L may be any suitable length listed in Table 2 (above). Tabletop 1402 may have a width W. Width W may be any suitable width listed in Table 3 (above). Tabletop 1402 may include a height $H_1$. Height $H_1$ may be any suitable height of a tabletop. Length L, width W, and height $H_1$ may vary. Length L, width W, and height $H_1$ may be customizable.

Heavy-duty table 1400 may include table legs 1404 and 1406. Table legs 1404 and 1406 may be fixed-height legs. $H_3$, the height of table legs 1404 and 1406, in addition to $H_1$ may define the height, $H_2$, of heavy-duty table 1400. Height $H_2$ may be any height included in the range of heights listed in Table 5 (above).

Figure 15:
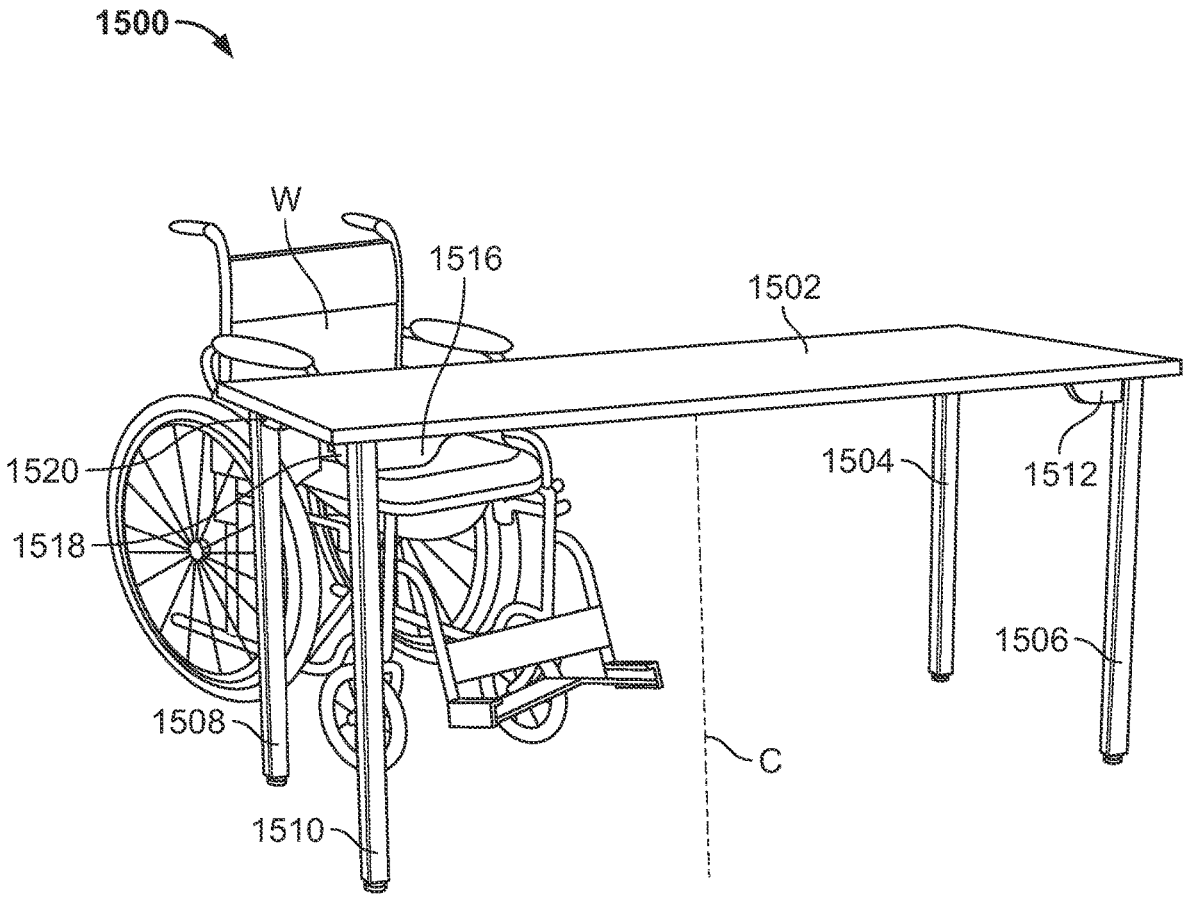
FIG. 15 shows another illustrative apparatus in accordance with principles of the disclosure.

FIG. 15 shows illustrative view of heavy-duty table 1500. Heavy-duty table 1500 may have one or more features in common with one or more of heavy-duty tables 100, 200, 500, 900, 1100, 1200, 1300 and 1400.

Heavy-duty table 1500 may include tabletop 1502. Heavy-duty table 1500 may include table legs 1504, 1506, 1508 and 1510. Table legs 1504, 1506, 1508 and 1510 may be mounted to four corners of tabletop 1502. A height of table legs 1504, 1506, 1508 and 1510 may define clearance C under heavy-duty table 1500. Because heavy-duty table 1500 is supported by apron ends, such as apron ends 1512, 1516, 1518 and 1520 and apron supports (not shown), clearance C may enable heavy-duty table 1500 to be accessible. Because apron ends 1512, 1516, 1518 and 1520 only extend in the corners of table 1500, heavy-duty table 1500 may be accessible by wheelchair W. Because clearance C enables wheelchair W to access heavy-duty table 1500, heavy-duty table may comply with Americans with Disabilities Act ("ADA") table-accessibility standards.

Figure 16A:
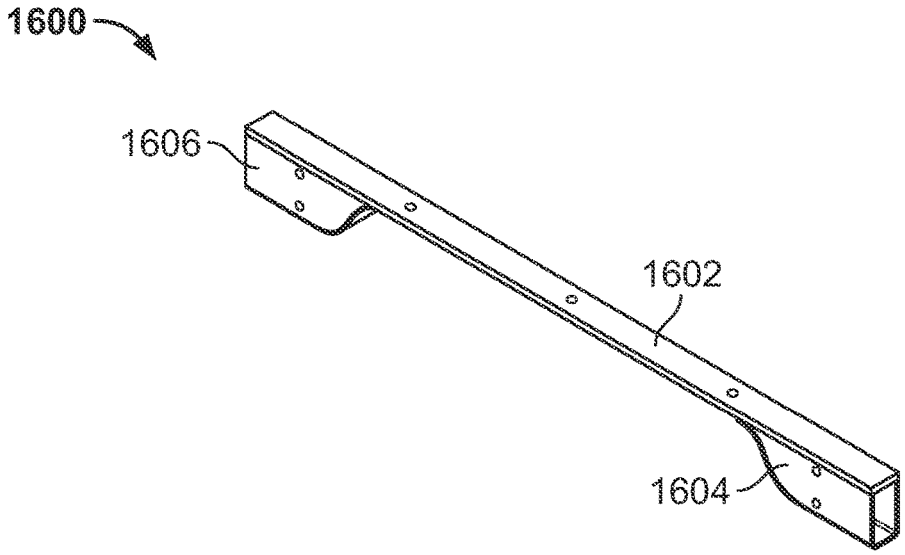
FIGS. 16A-16C show another illustrative apparatus in accordance with principles of the disclosure.

FIG. 16A shows illustrative apron 1600. Apron 1600 may include one or more features in common with apron 400. Apron 1600 may include apron support 1602. Apron ends 1604 and 1606 may be welded to apron support 1602.

Figure 16B:
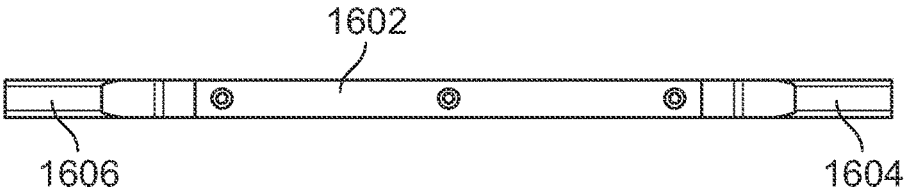

FIG. 16B shows a top view of apron 1600.

Figure 16C:
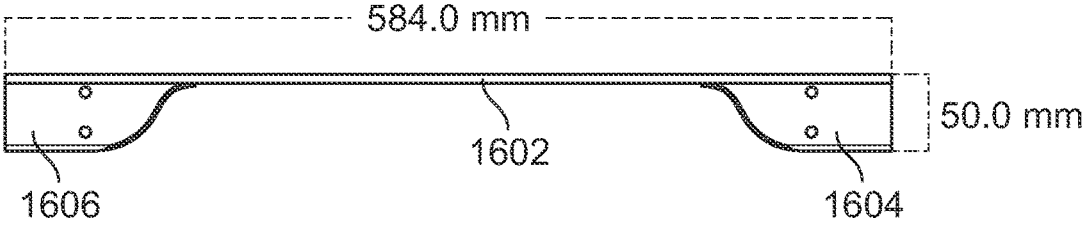

FIG. 16C shows a side view of apron 1600. Apron support 1602 may have a length of about 584.0 millimeters ("mm"). Apron 1600 may have a height of about 50.0 mm.

Figure 17A:
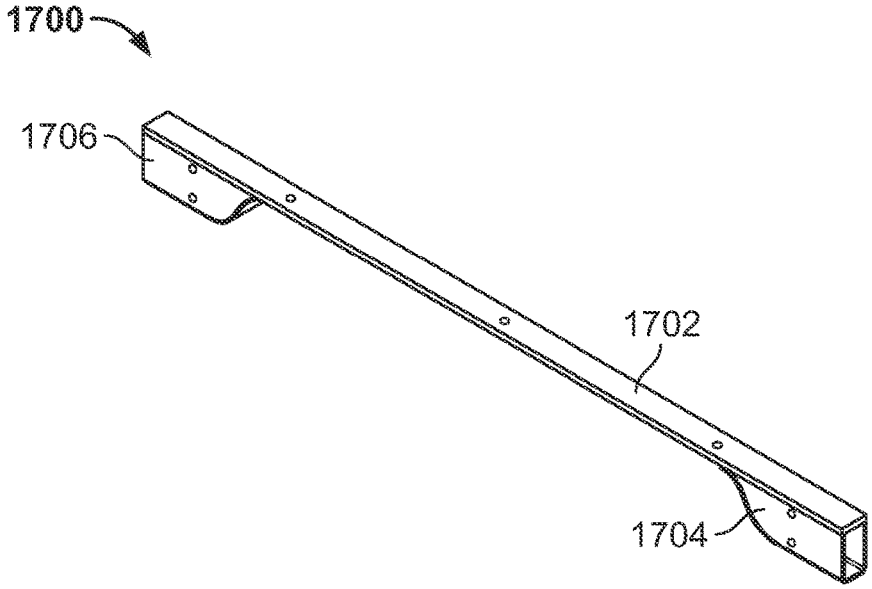
FIGS. 17A-17C show another illustrative apparatus in accordance with principles of the disclosure.

FIG. 17A shows illustrative apron 1700. Apron 1700 may include one or more features in common with apron 400. Apron 1700 may include apron support 1702. Apron ends 1704 and 1706 may be welded to apron support 1702.

Figure 17B:
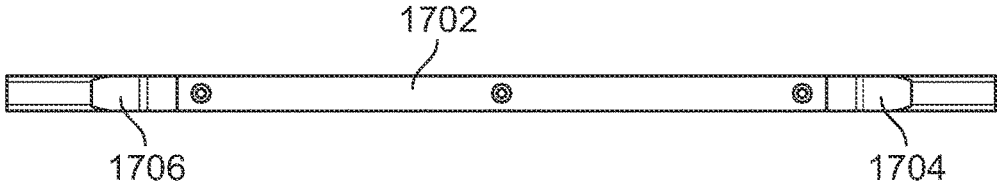

FIG. 17B shows a top view of apron 1700.

Figure 17C:
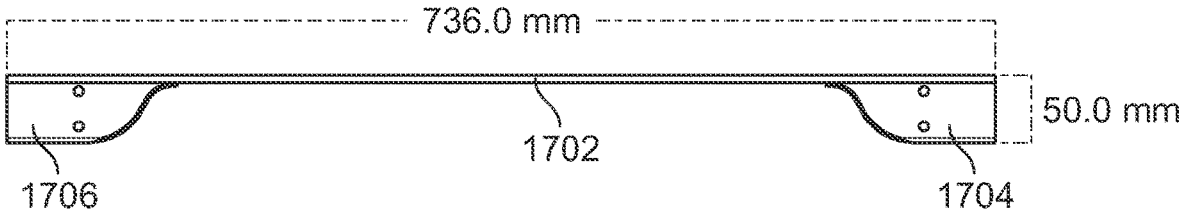

FIG. 17C shows a side view of apron 1700. Apron support 1702 may have a length of about 736.0 mm. Apron 1700 may have a height of about 50.0 mm.

Figure 18A:
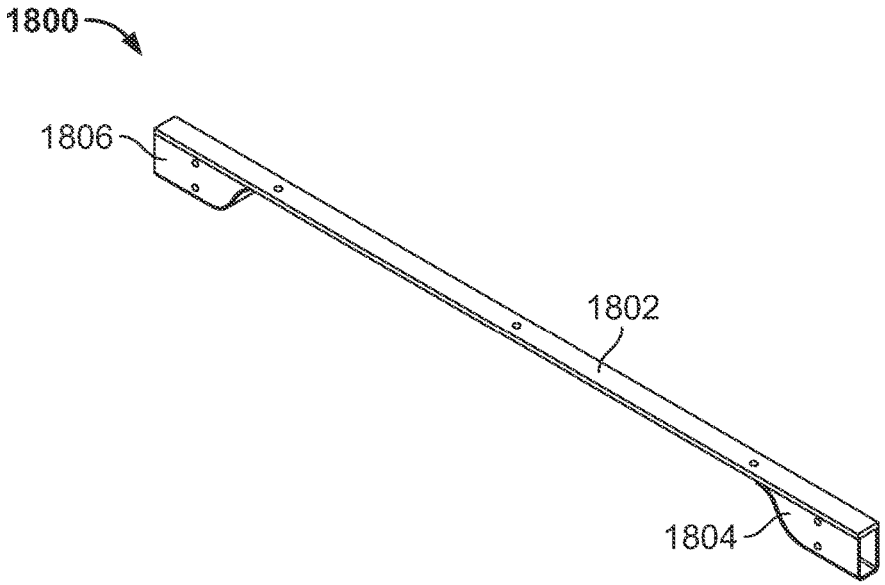
FIGS. 18A-18C show another illustrative apparatus in accordance with principles of the disclosure.

FIG. 18A shows illustrative apron 1800. Apron 1800 may include one or more features in common with apron 400. Apron 1800 may include apron support 1802. Apron ends 1804 and 1806 may be welded to apron support 1802.

Figure 18B:
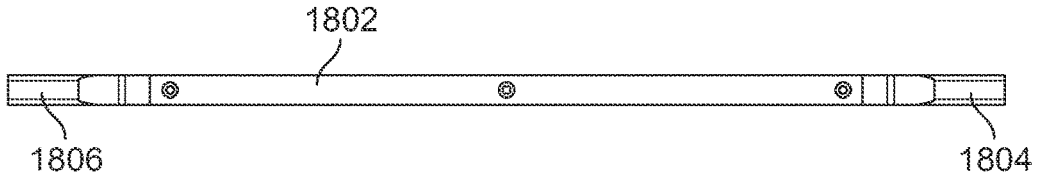

FIG. 18B shows a top view of apron 1800.

Figure 18C:
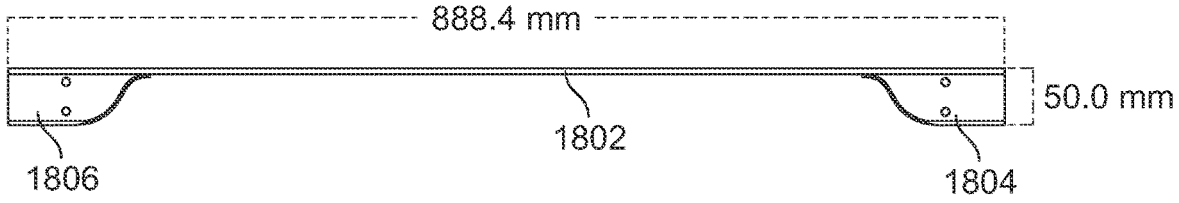

FIG. 18C shows a side view of apron 1800. Apron support 1802 may have a length of about 888.4 mm. Apron 1800 may have a height of about 50.0 mm.

Figure 19A:
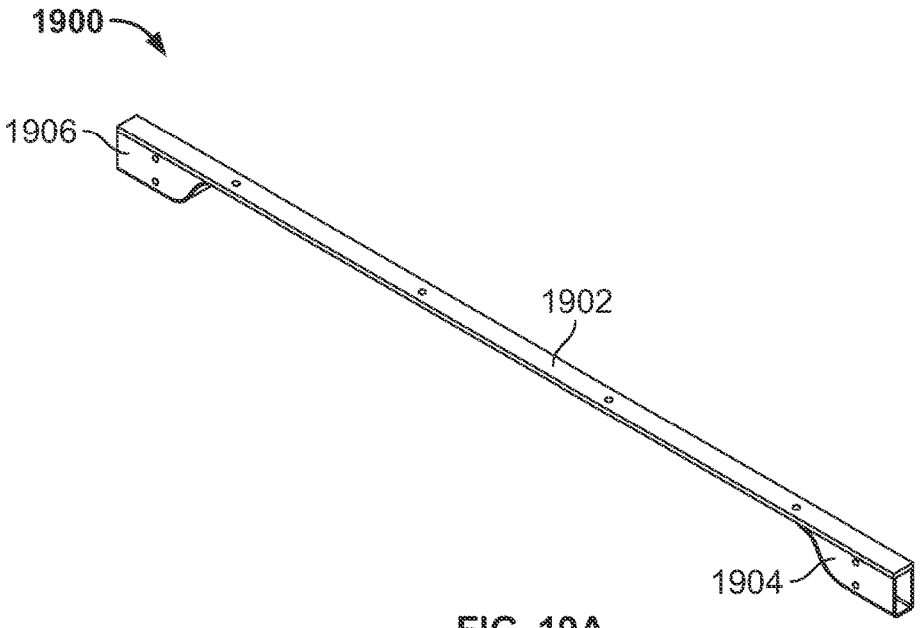
FIGS. 19A-19C show another illustrative apparatus in accordance with principles of the disclosure.

FIG. 19A shows illustrative apron 1900. Apron 1900 may include one or more features in common with apron 400. Apron 1900 may include apron support 1902. Apron ends 1904 and 1906 may be welded to apron support 1902.

Figure 19B:
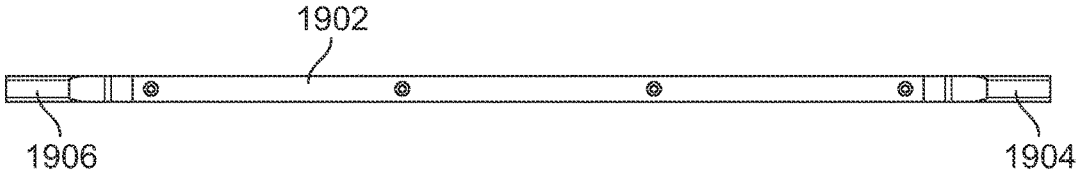

FIG. 19B shows a top view of apron 1900.

Figure 19C:
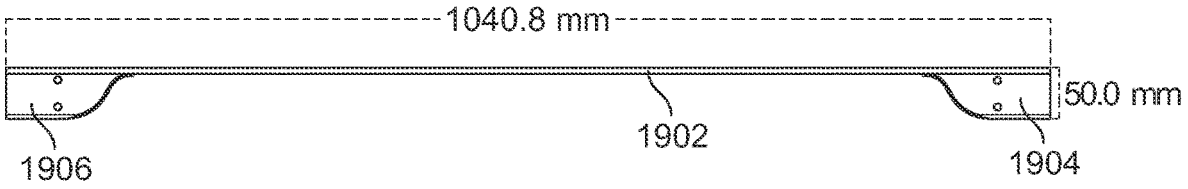

FIG. 19C shows a side view of apron 1900. Apron support 1902 may have a length of about 1040.8 mm. Apron 1900 may have a height of about 50.0 mm.

Figure 20A:
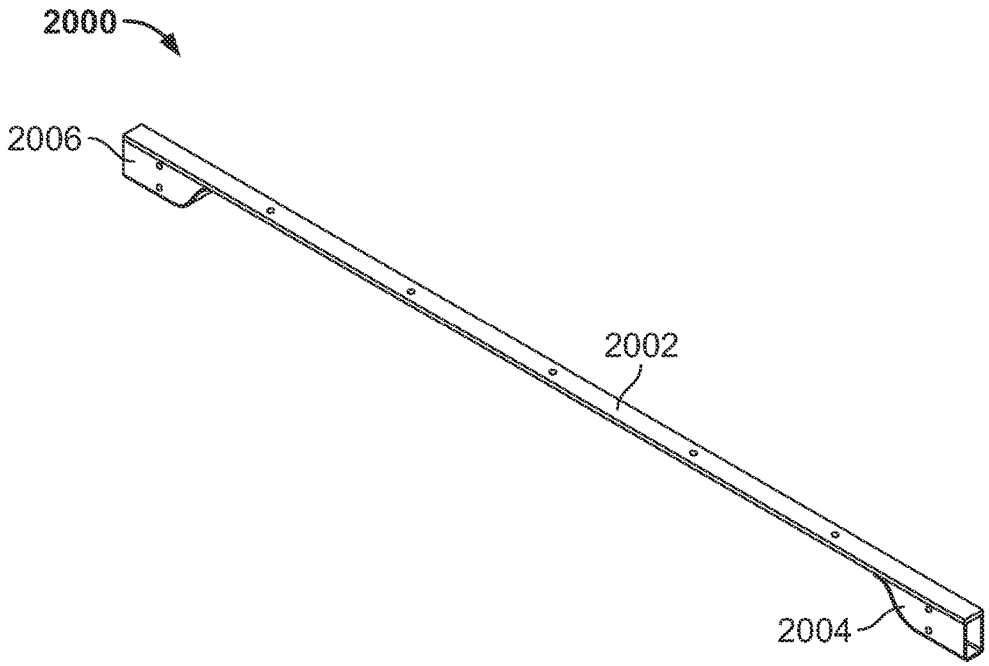
FIGS. 20A-20C show another illustrative apparatus in accordance with principles of the disclosure.

FIG. 20A shows illustrative apron 2000. Apron 2000 may include one or more features in common with apron 400.

Apron 2000 may include apron support 2002. Apron ends 2004 and 2006 may be welded to apron support 2002.

Figure 20B:
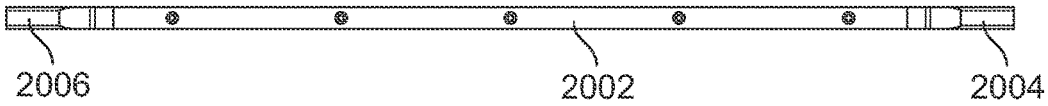

FIG. 20B shows a top view of apron 2000.

Figure 20C:
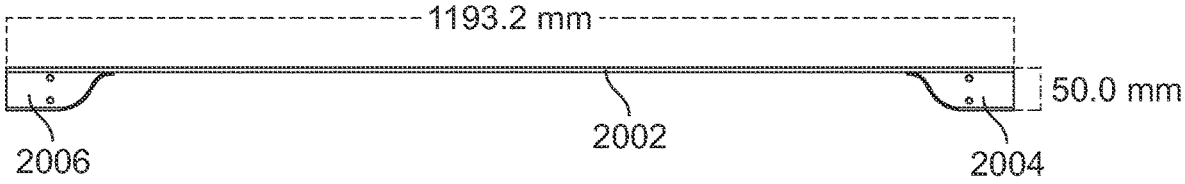

FIG. 20C shows a side view of apron 2000. Apron support 2002 may have a length of about 1193.2 mm. Apron 2000 may have a height of about 50.0 mm.

Figure 21A:
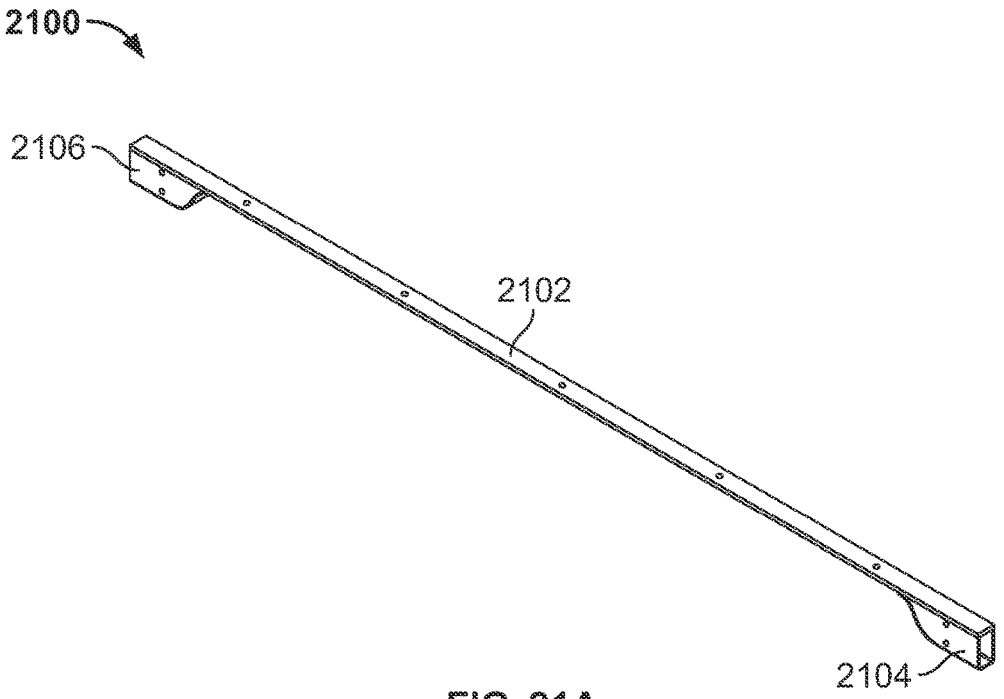
FIGS. 21A-21C show another illustrative apparatus in accordance with principles of the disclosure.

FIG. 21A shows illustrative apron 2100. Apron 2100 may include one or more features in common with apron 400. Apron 2100 may include apron support 2102. Apron ends 2104 and 2106 may be welded to apron support 2102.

Figure 21B:
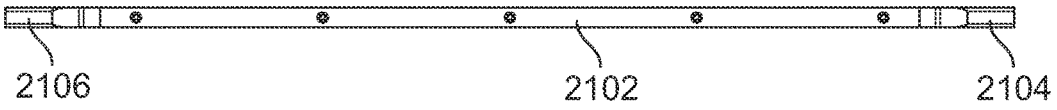

FIG. 21B shows a top view of apron 2100.

Figure 21C:
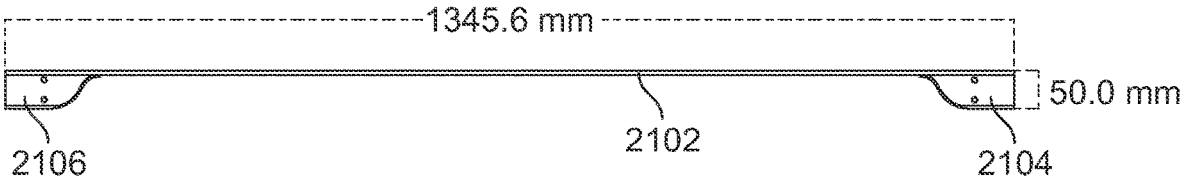

FIG. 21C shows a side view of apron 2100. Apron support 2102 may have a length of about 1345.6 mm. Apron 2100 may have a height of about 50.0 mm.

Figure 22A:
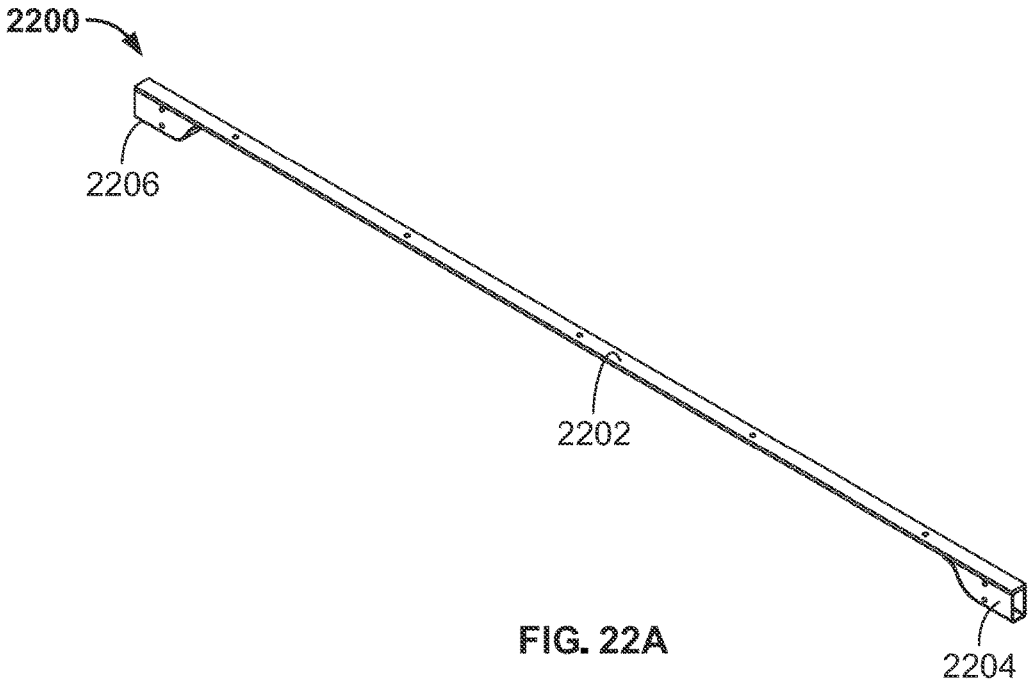
FIGS. 22A-22C show another illustrative apparatus in accordance with principles of the disclosure.

FIG. 22A shows illustrative apron 2200. Apron 2200 may include one or more features in common with apron 400. Apron 2200 may include apron support 2202. Apron ends 2204 and 2206 may be welded to apron support 2202.

Figure 22B:
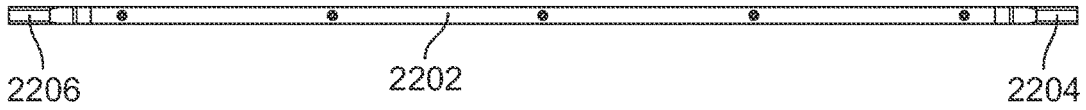

FIG. 22B shows a top view of apron 2200.

Figure 22C:
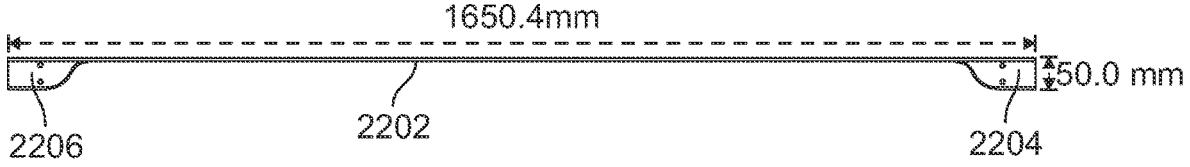

FIG. 22C shows a side view of apron 2200. Apron support 2202 may have a length of about 1650.4 mm. Apron 2200 may have a height of about 50.0 mm.

Figure 23A:
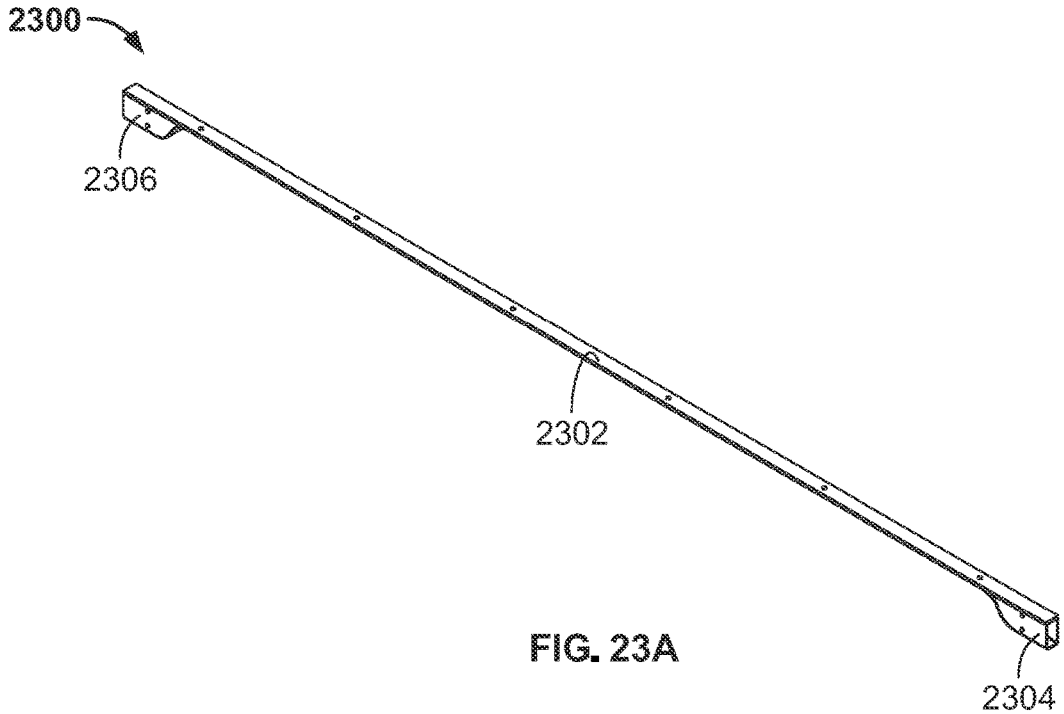
FIGS. 23A-23C show another illustrative apparatus in accordance with principles of the disclosure.

FIG. 23A shows illustrative apron 2300. Apron 2300 may include one or more features in common with apron 400. Apron 2300 may include apron support 2302. Apron ends 2304 and 2306 may be welded to apron support 2302.

Figure 23B:
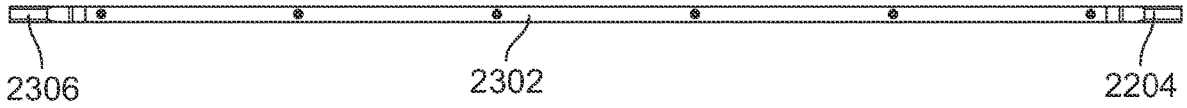

FIG. 23B shows a top view of apron 2300.

Figure 23C:
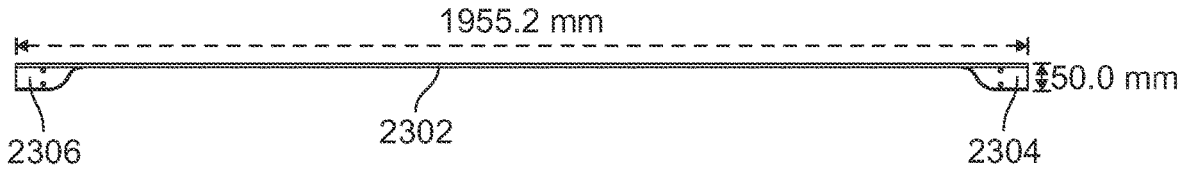

FIG. 23C shows a side view of apron 2300. Apron support 2302 may have a length of about 1955.2 mm. Apron 2300 may have a height of about 50.0 mm.

Figure 24A:
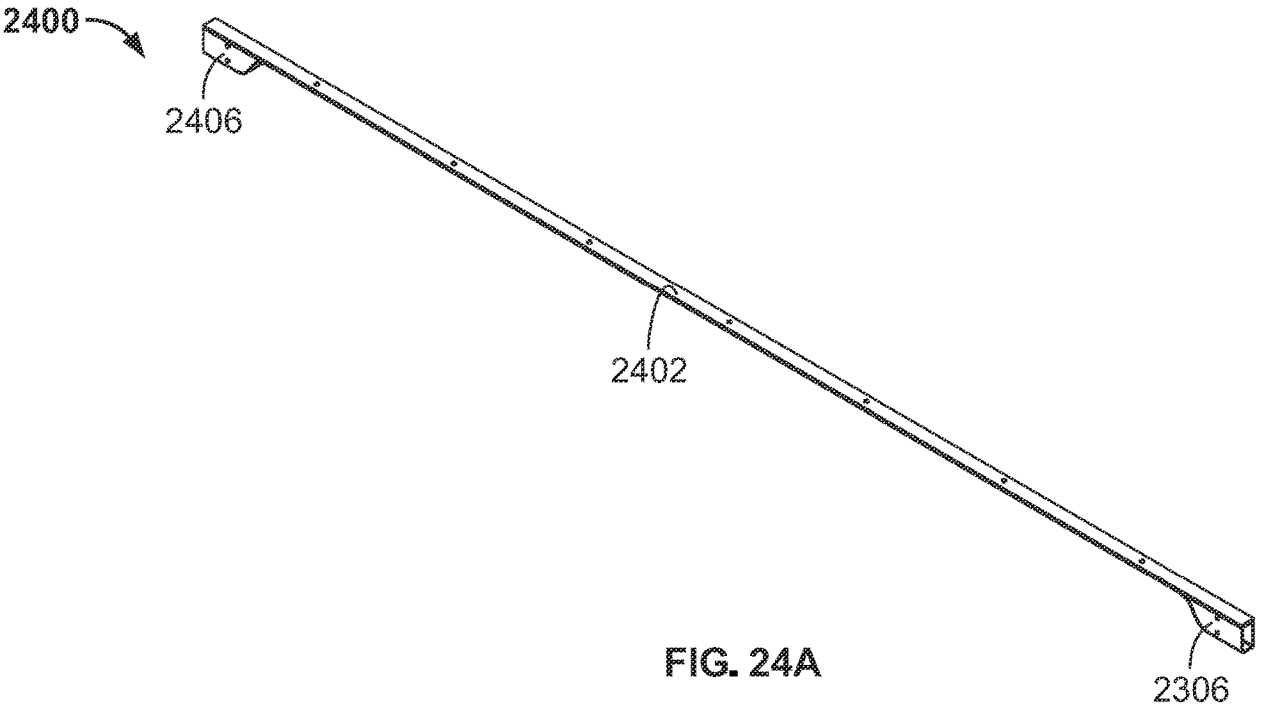
FIGS. 24A-24C show another illustrative apparatus in accordance with principles of the disclosure.

FIG. 24A shows illustrative apron 2400. Apron 2400 may include one or more features in common with apron 400. Apron 2400 may include apron support 2402. Apron ends 2404 and 2406 may be welded to apron support 2402.

Figure 24B:
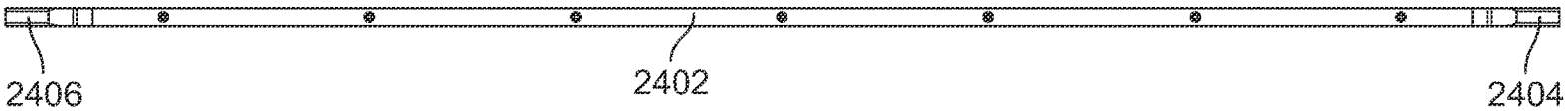

FIG. 24B shows a top view of apron 2400.

Figure 24C:
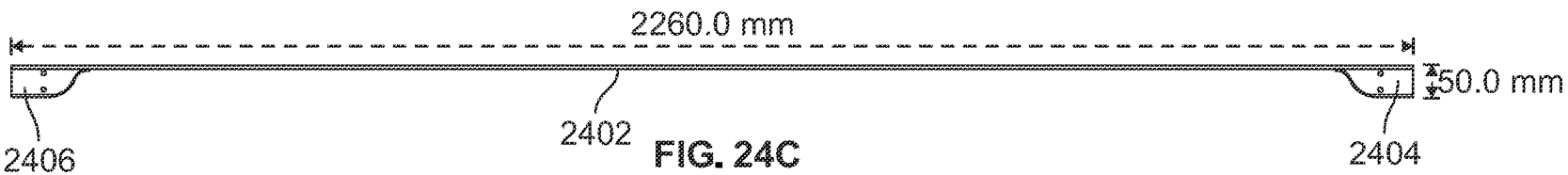

FIG. 24C shows a side view of apron 2400. Apron support 2402 may have a length of about 2260.0 mm. Apron 2400 may have a height of about 50.0 mm.

Figure 25A:
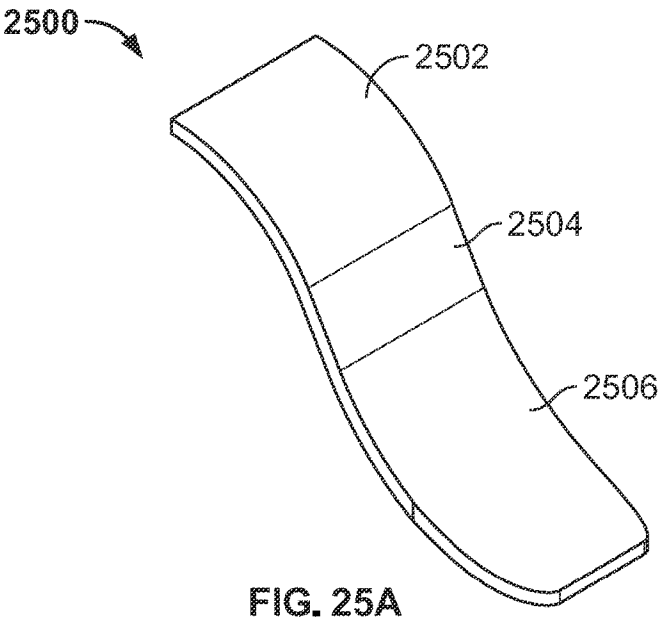
FIGS. 25A-25D show another illustrative apparatus in accordance with principles of the disclosure.

FIG. 25A shows illustrative apron end cover 2500. Apron end cover 2500 may include convex up portion 2502. Apron end cover 2500 may include convex down portion 2506. Apron end cover 2500 may include middle portion 2504.

Figure 25B:
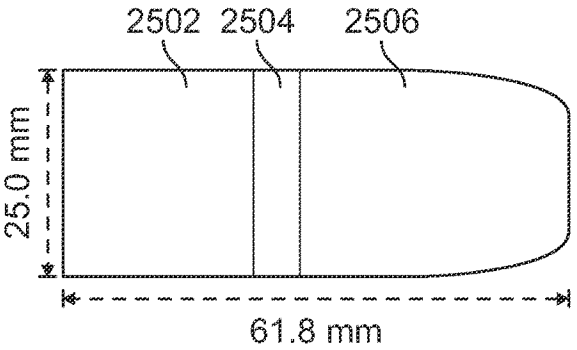

FIG. 25B shows apron end cover 2500 from a top view. Apron end cover 2500 may have a width of about 25.00 mm. Apron end cover 2500 may have a length of about 61.8 mm.

Figure 25C:
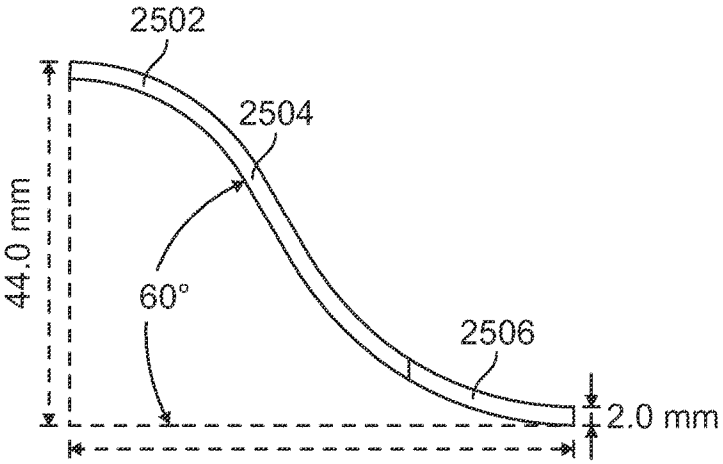

FIG. 25C shows apron end cover 2500 from a side view. Middle portion 2504 may be curved at about 600 angle. Apron end cover 2500 may have a thickness of about 2.0 mm. Apron end cover 2500 may be disposed in a position that has a height of about 44.0 mm. The 60° angle may define a change in height of apron end cover 2500 from 44 mm to 2 mm.

Figure 25D:
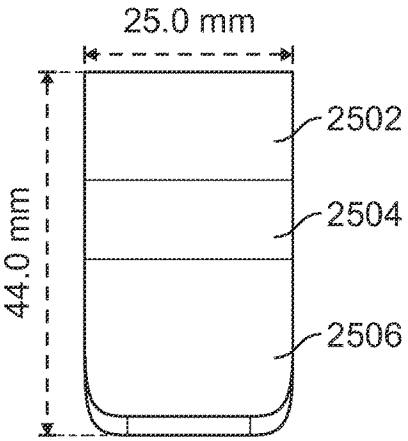

FIG. 25D shows apron end cover 2500 from a front view.

Figure 26B:
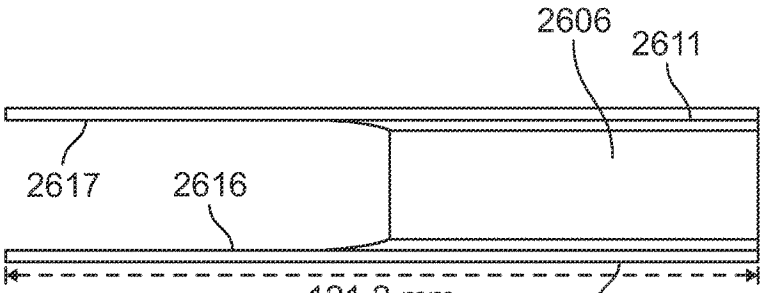
FIGS. 26A-26F show another illustrative apparatus in accordance with principles of the disclosure.
Figure 26D:
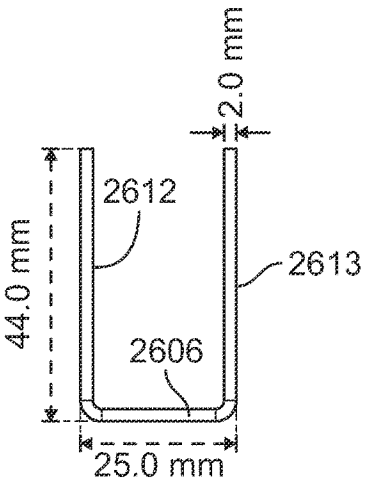
Figure 26A:
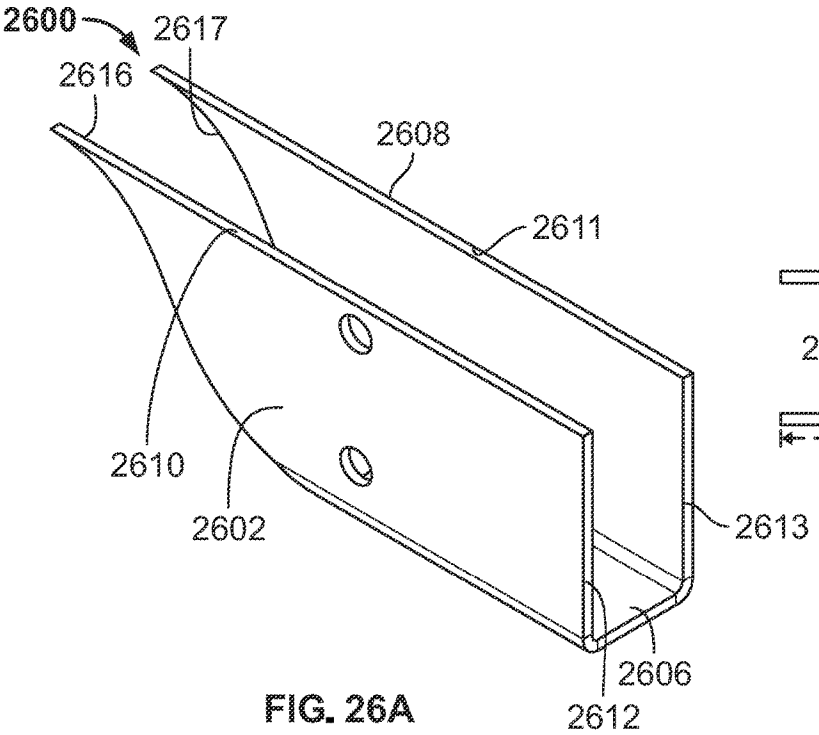

FIG. 26A shows an illustrative view of apron end 2600. Apron end 2600 may include first side surface 2602. First side surface 2602 may include curved end 2616. First side surface 2602 may include flat end 2612. First side surface 2602 may include top end 2610. First side surface 2602 may include tapped holes. The tapped holes may be threaded. The tapped holes may be configured to accept screws. Apron end 2600 may include second side surface 2608. Second side surface 2608 may include curved end 2617. Second side surface 2608 may include flat end 2613. Second side surface 2608 may include top end 2611. Apron end 2600 may include bottom surface 2606. Bottom surface 2606 may connect first side surface 2602 to second side surface 2608.

Curved ends 2616 and 2617 may define a curved open end of apron end 2600. Flat ends 2612 and 2613 may define a flat open end of apron end 2600. Top ends 2610 and 2611 may define top edges of apron end 2600.

FIG. 26B shows apron end 2600 from a top view. Top ends 2610 and 2611 may have a length of about 121.2 mm.

Figure 26C:
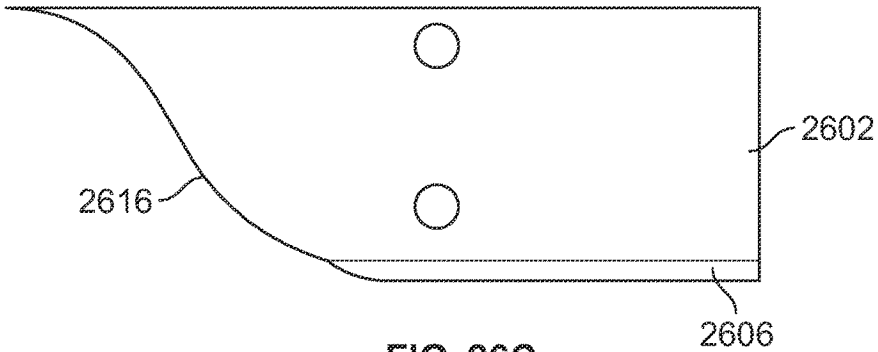

FIG. 26C shows a side view of apron end 2600.

FIG. 26D shows another side view of apron end 2600. First side surface 2602 and second side surface 2608 may have a thickness of about 2.0 mm. First side surface 2602 and second side surface 2608 may have a height of about 44.00 mm. Bottom surface 2606 may have a length of 25.0 mm.

Figure 26E:
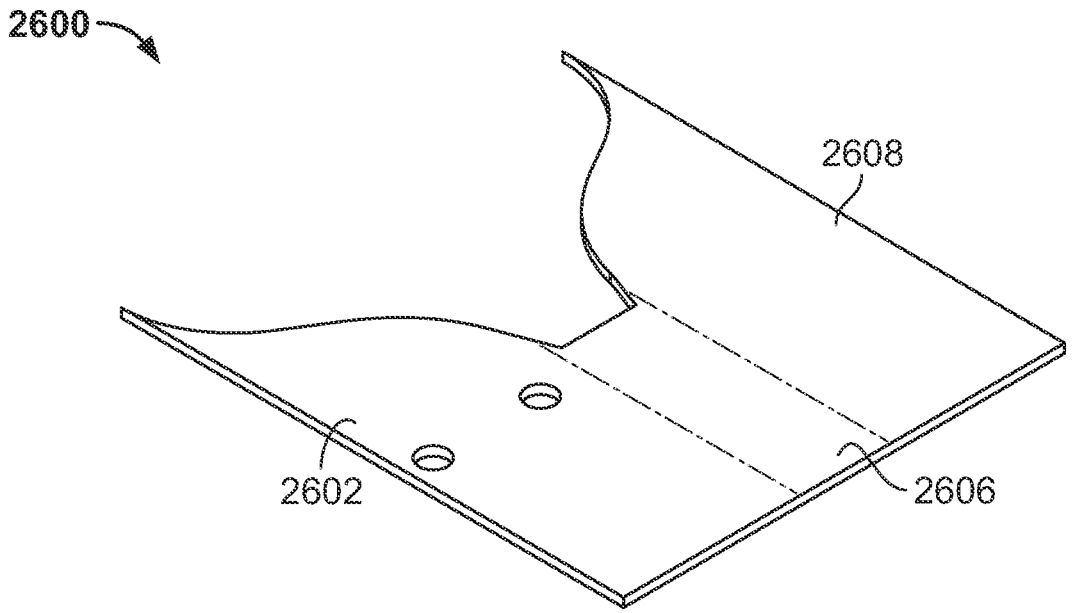

FIG. 26E shows a view of pre-assembled apron end 2600. In the pre-assembled configuration, apron end 2600 may include a single sheet of metal. The single sheet of metal may be folded to create assembled apron end 2600.

Figure 26F:
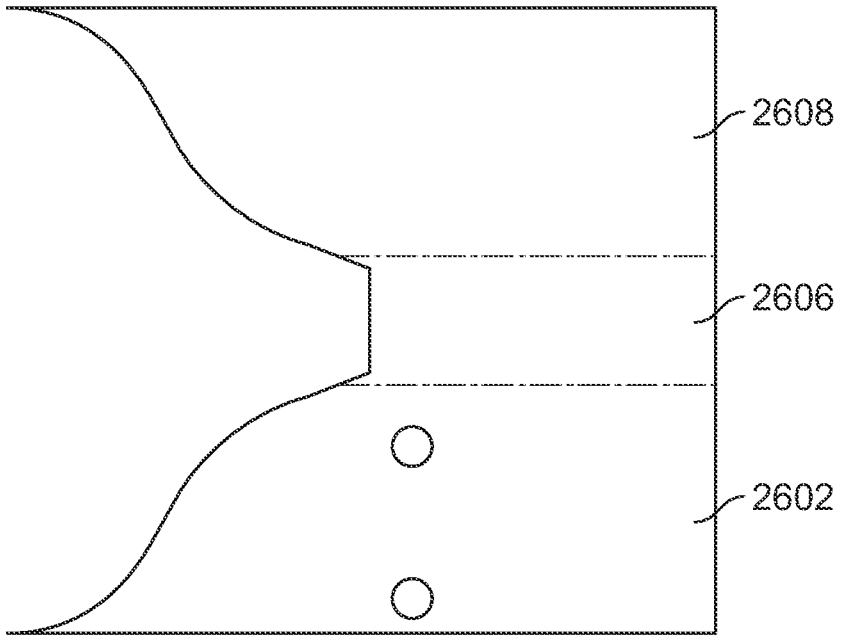

FIG. 26F shows another view of pre-assembled apron end 2600.

Figures 27A, 27B, 27C:
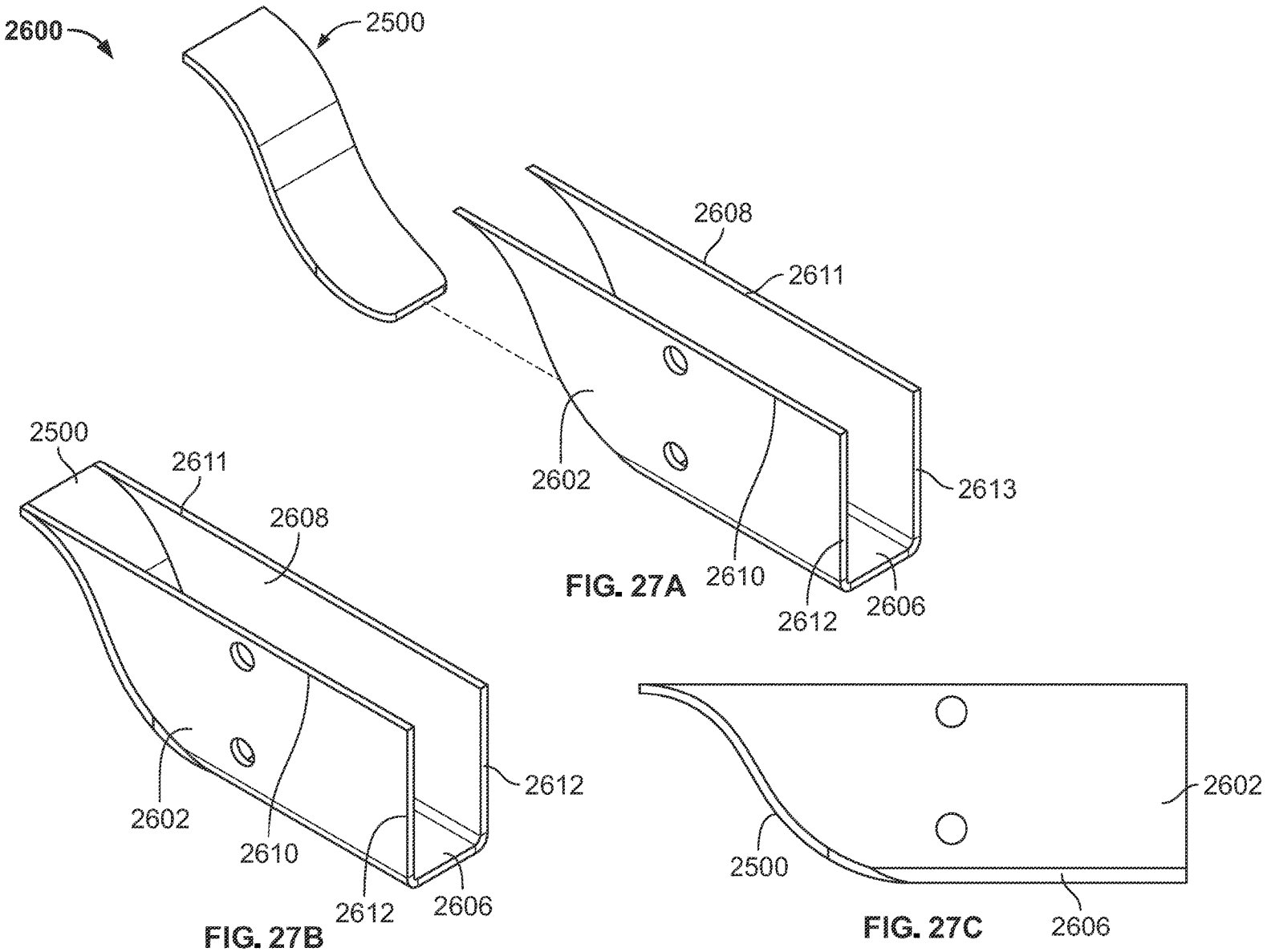
FIGS. 27A-27C show another illustrative apparatus in accordance with principles of the disclosure.

FIG. 27A shows a view of apron end 2600 being welded to apron end cover 2500. Apron end cover 2500 may be welded to curved ends 2616 and 2617 and bottom surface 2606.

FIG. 27B shows another view of apron end 2600 being welded to apron end cover 2500.

FIG. 27C shows a side view of apron end 2600 being welded to apron end cover 2500.

The steps of methods may be performed in an order other than the order shown and/or described herein. Embodiments may omit steps shown and/or described in connection with illustrative methods. Embodiments may include steps that are neither shown nor described in connection with illustrative methods.

Illustrative method steps may be combined. For example, an illustrative method may include steps shown in connection with another illustrative method.

Apparatus may omit features shown and/or described in connection with illustrative apparatus. Embodiments may include features that are neither shown nor described in connection with the illustrative apparatus. Features of illustrative apparatus may be combined. For example, an illustrative embodiment may include features shown in connection with another illustrative embodiment.

The drawings show illustrative features of apparatus and methods in accordance with the principles of the invention. The features are illustrated in the context of selected embodiments. It will be understood that features shown in connection with one of the embodiments may be practiced in accordance with the principles of the invention along with features shown in connection with another of the embodiments.

One of ordinary skill in the art will appreciate that the steps shown and described herein may be performed in other than the recited order and that one or more steps illustrated may be optional. The methods of the above-referenced embodiments may involve the use of any suitable elements, steps, computer-executable instructions, or computer-readable data structures. In this regard, other embodiments are disclosed herein as well that can be partially or wholly implemented on a computer-readable medium, for example, by storing computer-executable instructions or modules or by utilizing computer-readable data structures. For example, methods for producing an apparatus may, in certain embodiments, be wholly or partially executed by designing the apparatus via software, such as computer aided design (CAD) software.

All ranges and parameters disclosed herein shall be understood to encompass any and all subranges subsumed therein, every number between the endpoints, and the endpoints. For example, a stated range of "1 to 10" should be considered to include any and all subranges between (and inclusive of) the minimum value of 1 and the maximum value of 10; that is, all subranges beginning with a minimum value of 1 or more (e.g. 1 to 6.1), and ending with a maximum value of 10 or less (e.g., 2.3 to 10.4, 3 to 8, 4 to 7), and finally to each number 1, 2, 3, 4, 5, 6, 7, 8, 9, and 10 contained within the range.

Thus apparatus, methods and systems for a HEAVY-DUTY DESIGNER TABLE APRON are provided. Persons skilled in the art will appreciate that the present invention can be practiced by other than the described embodiments, which are presented for purposes of illustration rather than of limitation, and that the present invention is limited only by the claims that follow.

What is claimed is:

1. A heavy-duty table comprising:
- a tabletop, comprising a plurality of corners;
- a plurality of table legs, each of the table legs disposed at a corresponding one of the plurality of corners, each of the plurality of table legs comprising a first inner side and a second inner side, the first inner side and second inner side configured to intersect at a 90° angle; and
- a plurality of aprons, the plurality of aprons including:
  - an apron support, the apron support:
    - including sheet metal; and
    - configured to be mounted on a bottom side of the tabletop between an inner side of a first table leg and an inner side of a second table leg; and
  - two apron ends, each of the apron ends including:
    - angular metal tubing having a first side surface, a second side surface, a bottom surface, a flat open end, a curved open end, and two top edges; and
    - an apron end cover, the apron end cover configured to be welded to the first side surface, the second side surface, and the bottom surface, following the welding the apron end cover converting the curved open end to a curved closed end;
    - wherein:
      - the two top edges of a first apron end are configured to be welded to a first side of the apron support with the flat open end of the first apron end configured to be disposed adjacent the inner side of the first table leg; and
      - the two top edges of a second apron end are configured to be welded to a second side of the apron support with the flat open end of the second apron end disposed adjacent the inner side of the second table leg;

wherein each of the plurality of aprons is configured to support the heavy-duty table.

2. The heavy-duty table of claim 1 wherein the sheet metal of the apron support is configured to have a height of no more than 6 millimeters ("mm").

3. The heavy-duty table of claim 1 wherein the sheet metal of the apron support is configured to have a width of about 25 millimeters ("mm").

4. The heavy-duty table of claim 1 wherein the heavy-duty table further includes:
- four corners;
- four table legs, each of the table legs corresponding to one of the four corners;
- four aprons, each of the four aprons disposed between two table legs;

wherein:
- two of the four aprons have a first length; and
- two of the four aprons have a second length.

5. The heavy-duty table of claim 4 further including four corner brackets, each of the four corner brackets configured to be mounted to:
- a table leg;
- an apron end from a first apron disposed adjacent a first inner side of the table leg; and
- an apron end from a second apron disposed adjacent a second inner side of the table leg.

6. The heavy-duty table of claim 1 wherein the heavy-duty table is Americans with Disabilities Act ("ADA") compliant.

7. The heavy-duty table of claim 6 wherein clearance under the tabletop is not less than 26 inches and not greater than 34 inches.

8. The heavy-duty table of claim 1 wherein the angular metal tubing of the apron ends includes 13.5-gauge steel.

9. The heavy-duty table of claim 1, the apron end cover further including:
- a convex upward portion;
- a convex downward portion; and
- a middle portion;

wherein, the middle portion is curved at a 60° angle with respect to the two top edges of the apron end.

10. The heavy-duty table of claim 9 wherein the curve of the middle portion defines a change in height of the apron end from 44 millimeters to 2 millimeters.

11. An apparatus for supporting a table, the apparatus including:
- an apron, the apron including:
  - an apron support, the apron support:
    - including sheet metal; and
    - configured to be mounted on a bottom side of a tabletop between a first table leg and a second table leg; and
  - two apron ends, each of the apron ends including:
    - angular metal tubing having a first side surface, a second side surface, a bottom surface, a flat open end, a curved open end, and two top edges; and
    - an apron end cover, the apron end cover configured to be welded to the first side surface, the second side surface, and the bottom surface, following the welding the apron end cover converting the curved open end to a curved closed end;
    - wherein:
      - the two top edges of a first apron end are configured to be welded to a first end of the apron support with the flat open end of the first apron end configured to be disposed adjacent the first table leg; and
      - the two top edges of a second apron end are configured to be welded to a second end of the apron support with the flat open end of the second apron end disposed adjacent the second table leg;

wherein the apron is configured to support the table.

12. The apparatus of claim 11 wherein the sheet metal of the apron support is configured to have a height of no more than 6 millimeters ("mm").

13. The apparatus of claim 11 wherein the sheet metal of the apron support is configured to have a width of about 25 millimeters ("mm").

14. The apparatus of claim 11 including four aprons wherein the four aprons are further configured to be mounted to a heavy-duty table, the heavy-duty table comprising:

a tabletop including four corners;

four table legs, each of the table legs corresponding to one of the four corners, each of the four of table legs comprising a first inner side and a second inner side, the first inner side and second inner side configured to intersect at a 90° angle;

wherein:

each of the four aprons are configured to be mounted:

to a bottom side of the tabletop; and between the first inner side of a one table leg and the second inner side of another table leg;

two of the four aprons have a first length;

two of the four aprons have a second length; and each of the four aprons are configured to support the tabletop.

15. The apparatus of claim 14 wherein the heavy-duty table further includes four corner brackets, each of the four corner brackets configured to be mounted to:

a table leg;

an apron end from a first apron disposed adjacent a first inner side of the table leg; and an apron end from a second apron disposed adjacent a second inner side of the table leg.

16. The apparatus of claim 14 wherein the four aprons are further configured to be mounted to the bottom side of the tabletop using screws.

17. The apparatus of claim 11 wherein the sheet metal of the apron support includes 3-gauge steel.

18. The apparatus of claim 11, the apron end cover further including:

a convex upward portion;

a convex downward portion; and a middle portion;

wherein, the middle portion is curved at a 60° angle with respect to the two top edges of the apron end.

19. The apparatus of claim 18 wherein the curve of the middle portion defines a change in height of the apron end from 44 millimeters to 2 millimeters.

20. A heavy-duty table comprising:

a tabletop, comprising a plurality of corners;

a plurality of table legs, each of the table legs disposed at a corresponding one of the plurality of corners, each of the plurality of table legs comprising a first inner side and a second inner side, the first inner side and second inner side configured to intersect at a 90° angle;

a plurality of mounting brackets, each of the plurality of mounting brackets configured to be welded to a respective one of the plurality of table legs and fixedly attached to a bottom of the tabletop; and a plurality of aprons, the plurality of aprons including:

an apron support, the apron support:

including sheet metal; and configured to be mounted on the bottom of the tabletop between an inner side of a first table leg and an inner side of a second table leg; and two apron ends, each of the apron ends including:

angular metal tubing having a first side surface, a second side surface, a bottom surface, a flat open end, a curved open end, and two top edges; and an apron end cover, the apron end cover configured to be welded to the first side surface, the second side surface, and the bottom surface, following the welding the apron end cover converting the curved open end to a curved closed end;

wherein:

the two top edges of a first apron end are configured to be welded to a first side of the apron support with the flat open end of the first apron end configured to be disposed adjacent the inner side of the first table leg; and the two top edges of a second apron end are configured to be welded to a second side of the apron support with the flat open end of the second apron end disposed adjacent the inner side of the second table leg;

wherein each of the plurality of aprons is configured to support the heavy-duty table.

* * * * *